US006147550A

United States Patent [19]

Holloway

[11] Patent Number: 6,147,550

[45] Date of Patent: Nov. 14, 2000

[54] METHODS AND APPARATUS FOR RELIABLY DETERMINING SUBTHRESHOLD CURRENT DENSITIES IN TRANSCONDUCTING CELLS

[75] Inventor: Peter R. Holloway, Andover, Mass.

[73] Assignee: National Semiconductor Corporation, Santa Clara, Calif.

[21] Appl. No.: 09/012,374

[22] Filed: Jan. 23, 1998

[51] Int. Cl.[7] ..... G05F 3/02

[52] U.S. Cl. ..... 327/544; 327/538

[58] Field of Search ..... 327/530, 538, 327/544, 103, 108, 535

[56] References Cited

U.S. PATENT DOCUMENTS

| | | | |
|---|---|---|---|
| 4,612,461 | 9/1986 | Sood | 307/475 |
| 5,187,389 | 2/1993 | Hall et al. | 327/530 |
| 5,467,306 | 11/1995 | Kaya et al. | 365/185.2 |
| 5,508,836 | 4/1996 | DeCaro et al. | 359/189 |
| 5,528,184 | 6/1996 | Gola et al. | 327/198 |
| 5,929,434 | 7/1999 | Kozlowski et al. | 250/214 A |

OTHER PUBLICATIONS

S. Hosotani et al., "An 8–bit 20–MS/s CMOS A/D Converter with 50–m W Power Consumption," *IEEE Journal of Solid–State Circuits,* vol. 25, No. 1, Feb. 1990, pp. 167–172.

*Primary Examiner*—Jung Ho Kim
*Attorney, Agent, or Firm*—Limbach & Limbach L.L.P.

[57] ABSTRACT

Methods and circuits for biasing a transconducting cell to operate in a subthreshold state so as to have a desired high transconductance, and systems including a master cell for generating a regulated bias voltage and one or more transconducting slave cells biased in subthreshold by the bias voltage. An example of such system is an inverting voltage amplifier (offering low power consumption, low noise, good stability, and high gain). The bias voltage is generated to be independent of process and environmental variations by servoing an unregulated supply voltage, and preferably has lower magnitude relative to ground than the supply voltage. Preferably, the master cell includes transistors in which a constant current density is maintained, and this current density is replicated in each slave cell biased by the master cell. Preferably, the master cell is configured to regulate the bias voltage precisely over a wide range of load currents from the slave cells, thus eliminating the need for a current boosting voltage follower between the master cell and each slave cell. The slave cell can comprise multiple transconducting stages (each biased in subthreshold), an integrator having multiple inverter stages (and at least one feedback stage providing displacement current to one of the stages), cascoded transistor pairs, or an NMOS transistor and PMOS transistor biased in subthreshold with gate potentials offset by different amounts above and below an input voltage.

28 Claims, 6 Drawing Sheets

METHODS AND APPARATUS FOR RELIABLY DETERMINING SUBTHRESHOLD CURRENT DENSITIES IN TRANSCONDUCTING CELLS

BACKGROUND OF THE INVENTION

1. Field of the Invention

The present invention relates generally to methods and circuits for biasing one or more transconducting cells to operate in a subthreshold state so as to have a desired high transconductance, and to systems including one or more transconducting cells biased in accordance with the invention to operate in subthreshold. More specifically, the invention relates to methods and circuits for biasing at least one transconducting cell to operate in subthreshold by setting the current density for at least one transistor of each cell such that the current density remains fixed (at a level at which the transistor operates in or near subthreshold) despite significant supply voltage variations, and to systems including at least one so-biased transconducting cell.

2. Description of the Related Art

Throughout the disclosure, including in the claims, the term "transconductance" (denoted by the symbol "$g_m$") denotes the change in channel current of a transistor, in response to a change in gate-to-source voltage $V_{GS}$ (for a MOSFET transistor) or in response to a change in base-to-emitter voltage $V_{BE}$ (for a bipolar transistor). Throughout the disclosure, including in the claims, the term "transconducting cell" denotes a circuit that comprises one or more transistors, is characterized by a transconductance (determined by the transconductance of each of said one or more transistors and, if there are more than one of said one or more transistors, by the manner in which said transistors are connected together), is operable in or near a subthreshold state in which the transconductance has a desired value, and has an output voltage determined by an input voltage. Typically, the invention is employed to bias an "inverting" transconducting cell whose output voltage decreases in response to increasing input voltage (and whose output voltage increases in response to decreasing input voltage).

A metal-oxide-semiconductor field-effect transistor ("MOSFET" or "MOS" transistor) has a "gate" terminal which capacitively modulates the conductance of a surface channel which joins two end contacts, known as a source and a drain. The gate is separated from a semiconductor body which underlies the gate by a thin gate insulator. This gate insulator is usually composed of silicon dioxide. The channel is formed at the interface between the semiconductor body and the gate insulator.

Although there are devices known as depletion-mode (normally on) MOSFETs, the term MOSFET is usually used to denote an enhancement-mode (normally off) device. The latter device is normally off because the body forms p-n junctions with both the source and the drain, so that no majority-carrier current can flow between the source and drain. Instead, minority-carrier current can flow, but only if minority carriers are available. For gate biases that are sufficiently attractive (i.e., above a threshold voltage), minority carriers are drawn into a surface channel, forming a conducting path from source to drain. Threshold voltage is often defined as the gate-to-source voltage $V_{GS}=V_{th}$ at which the channel begins to form (a more precise definition of threshold voltage will be discussed below with reference to FIG. 8). The gate and channel form two sides of a capacitor separated by the gate insulator. As additional attractive charges are placed on the gate side, the channel side of the capacitor draws a balancing charge of minority carriers from the source and the drain. With increasing charge on the gate, the channel is more populated, and the conductance increases. Because the gate creates the channel, to insure electrical continuity, the gate usually extends over the entire length of the separation between the source and the drain.

When the gate-to-source voltage of an N-channel MOSFET ("NMOS" transistor) rises to the threshold voltage $V_{th}$, the NMOS transistor begins to switch from off to on. When the gate-to-source voltage of a P-channel MOSFET ("PMOS" transistor) falls below the threshold voltage $V_{th}$, the PMOS transistor begins to switch from off to on. Above the threshold voltage, an NMOS transistor develops an excess of gate voltage beyond that required to "invert" the polarity of the carriers at the surface of the semiconductor. It is useful to think of this quantity, $V_{GS}-V_{th}$ as $V_{Gth}$, which has a "positive" value for an NMOS transistor and a corresponding "negative" value for a PMOS transistor.

The resulting NMOS (or PMOS) drain current than depends on both $V_{Gth}$ and the drain-to-source voltage, "$V_{ds}$". For an NMOS transistor, when $V_{ds} \ll V_{Gth}$ ("$-V_{ds} \ll -V_{Gth}$" for a PMOS transistor,) the device is said to operate in the "linear" region; and when $V_{ds} \geqq V_{Gth}$ ("$-V_{ds} \geqq -V_{Gth}$" for a PMOS transistor,) the device is said to operate in the "saturation" region; and when $\alpha V_{Gth} \leqq V_{ds} \leqq V_{Gth}$ ("$-\alpha V_{Gth} \leqq -V_{ds} \leqq -V_{Gth}$" for a PMOS transistor,) where $\alpha$ is a constant less than one (typically 0.1–0.25), the device is said to operate in the "triode" region.

Additionally, above the threshold voltage, an NMOS transistor (below the threshold voltage, a PMOS transistor) exhibits drain current versus gate bias characteristics which are dependent upon whether the MOSFET is a long-channel device or is a short-channel device. For a long-channel device, the current in saturation increases proportionally to the square of the gate bias. For short channel devices, the drain current exhibits a somewhat more linear increase in saturation current with gate bias.

Notwithstanding the relationships defined herein between $V_{ds}$ and $V_{Gth}$, and the resulting three "drain-bias" operating regions relating these quantities, and, notwithstanding certain non-idealities associated with said short-channel effects, an NMOS transistor is said to be operating "in subthreshold" whenever the value of $V_{GS}$ results in a relationship between the surface potential, "$\phi_s$", and the built-in potential, "$\phi_b$", such that $\phi_b \geqq \phi_s \geqq -\phi_b$ ("$\phi_b \geqq -\phi_s \geqq -\phi_b$" for a PMOS transistor.)

Additionally, within this range for $\phi_s$, for either an NMOS or PMOS transistor, when $\phi_s=\phi_b$, the semiconductor surface is neutral, i.e. neither accumulated nor depleted, and $V_{GS}$ is equal to the so-called flat-band voltage, "$V_{FB}$"; and when $\phi_s=-\phi_b$, the semiconductor surface is at the onset of so called strong inversion and $V_{Gth}=0$ (because of aforesaid definition of $V_{th}$); and when $|\phi_b| \geqq \phi_s \geqq -|\phi_b|$, the semiconductor surface goes from partial depletion through intrinsic and into weak inversion before attaining strong inversion.

Within said subthreshold region, the number of carriers in the channel is so small that their charge does not significantly affect the channel potential, and the channel carriers simply adapt to the potential set up between drain and source and to the space charge caused by depleted dopant ions in the channel.

When the mobile carriers are less numerous than the dopant ions, they are known as "minority" carriers. When the mobile carriers are more numerous than the dopant ions (which occurs for the first time at the strong inversion threshold, $V_{Gth}=0$,) they become known as "majority" carriers. In either case, the carriers remain of the same nature (electrons for NMOS devices and holes for PMOS devices) and contribute to current flow by drift and diffusion mechanisms. The practice of designating the carriers as minority and majority serve the purpose of segregating the relationship of channel-charge to gate bias, "$Q_{ch}(V_{GS})$", into two categories:

a subthreshold minority charge component, "$Q'_n$" for an NMOS device ("$Q'_p$" for a PMOS) which will subsequently be shown to vary exponentially with $V_{GS}$; and, a strong inversion majority charge component, "$Q_n$" for an NMOS device, ("$Q_p$" for a PMOS device) which will subsequently be shown to vary linearly with $V_{Gth}$ and, therefor $V_{GS}$. Thus, $Q_{ch}(V_{GS})=Q'_n+Q_n$ for an NMOS device and $Q_{ch}(V_{GS})=Q'_p+Q_p$ for a PMOS device.

For long-channel devices operating within the linear, triode or saturation regions, it can be shown that:

the subthreshold charge can be approximated as $$Qn = \frac{-kT}{2q}\sqrt{\frac{q\varepsilon_{si}Na}{\varphi_b}}\exp\left[\frac{q\left(V_{Gth}-\frac{V_d}{2}\right)}{kT}\right]$$

for NMOS devices and as $$Qp = \frac{kT}{2q}\sqrt{\frac{q\varepsilon_{si}Nd}{\varphi_b}}\exp\left[\frac{-q\left(V_{Gth}-\frac{V_d}{2}\right)}{kT}\right]$$

for PMOS devices, where "k" is the so called Boltzmann constant, "q"" is the electronic charge, "Na" is the acceptor dopant concentration in the channel of the NMOS device, "$N_d$" is the donor dopant concentration in the channel of the PMOS device, "$\epsilon_{si}$" is the permittivity of silicon, "$V_d$" is the drain-to-source voltage in the linear and triode regions but is limited to $V_d=V_{Gth}=$"$V_{ds\text{-}sat}$" in the saturation region; and, the strong inversion charge can be approximated as $$Q_n = -C'_{ox}WL\left(V_{Gth}-\frac{V_d}{2}\right)$$

for NMOS devices and as $$Q_p = -C'_{ox}WL\left(V_{Gth}-\frac{V_d}{2}\right)$$

for a PMOS devices, where "W" and "L" are the width and length of the channel, respectively, $C'_{ox}$ is the effective area gate capacitance, and "$V_d$" is the drain-to-source voltage in the linear and triode but is limited to $V_d=V_{Gth}=$"$V_{ds\text{-}sat}$" when operating in the saturation region where it is assumed that $V_{Gth}\geqq 0$ for an NMOS device and $V_{Gth}\geqq 0$ for a PMOS device.

It can be observed from the above expressions describing channel charge that the minority channel charge is exponentially dependant on $V_{GS}$ over all three drain-bias regions whereas the majority channel charge is only linearly dependant on $V_{Gth}$, and therefor $V_{GS}$, over all three drain-bias regions.

The drain current that results from the total charge in the channel is merely $$I_{ds}(V_{GS}) = \frac{Q_{ch}(V_{GS})}{\tau_{tr}}$$

where "$\tau_{tr}$" is the average time for a carrier to transit the channel. For an NMOS device, $\tau_{tr}=L^2/\mu_n V_d$, and, for a PMOS device, $\tau_{tr}=L^2/\mu_p V_d$, where "$\mu_n$" and "$\mu_p$" are the effective mobility for electrons and holes, respectively, and $I_{ds}$ can be restated as $$I_{ds}(V_{GS}) = \frac{Q_{ch}(V_{GS})V_d\mu_{n,p}}{L^2}$$

where "$\mu_{n,p}$" is $\mu$n for NMOS devices and $\mu_p$ for PMOS devices.

Because $I_{ds}$ is now proportional to $V_d$ for a fixed value of $Q_{ch}$, the effect of this factor, combined with the aforementioned dependance of both $Q'_n$ and $Q_n$ in NMOS devices (and $Q'_p$ and $Q_p$ in PMOS devices) on $V_d$, results in $I_{ds}$ having two components:

a minority carrier current component, "$I_{ds\text{-}minor}$", which is now proportional to $V_d\exp[q(V_{Gth}-V_d/2)/kT]$ in the linear and triode drain-bias regions and proportional to $V_{ds\text{-}sat}\exp[q(V_{Gth}-V_{ds\text{-}sat}/2)/kT]$ or, simplifying, $V_{Gth}\exp[q(V_{Gth})/2kT]$ in the saturation region; and a majority carrier current component, "$I_{ds\text{-}major}$", which is now proportional to $V_d(V_{Gth}-V_d/2)$ in the linear and triode drain-bias regions and proportional to $V_{ds\text{-}sat}(V_{Gth}-V_{ds\text{-}sat}/2)$ or, simplifying, $V_{Gth}^2/2$ in the saturation drain-bias region.

For short-channel devices, however, the source and drain are sufficiently close to each other to begin to share control of $V_{th}$. If this effect is too strong, a drain voltage dependence of the subthreshold characteristic, as well as the strong inversion characteristic, then occurs, which at least in switching applications, is undesirable because such condition increases the MOSFET off current and can cause a drain-bias dependent threshold voltage.

For a well-designed MOSFET $V_{th}$ does not depend significantly on the drain and the channel current characteristics remain substantially as described.

FIG. 8 is a graph of the square root of the channel current (i.e., the square root of the current "$I_{ds}$" at the transistor's drain) of a typical NMOS transistor whose drain and gate are connected together (and therefor operating in the saturation drain-bias region) plotted on the "y" axis, versus the gate-to-source voltage ("$V_{GS}$") plotted on the "x" axis. The graphed function is increasingly linear for values of $V_{GS}$ substantially above a minimum voltage (labeled "$V_{th}$" in FIG. 8), where the device is said to operate in "strong inversion." The threshold voltage of the device is often defined as the x-axis intercept of a tangent to the linear portion of the function. As shown in FIG. 8, such tangent intersects the x axis at the point labeled "$V_{threshold\text{-}extrapolated}$" which is defined to be the effective threshold voltage for the purpose of calculating "$I_{ds\text{-}major}$", the majority carrier component. At values of $V_{GS}$ below $V_{threshold\text{-}extrapolated}$, the device is said to be operating in "deep subthreshold" and $I_{ds\text{-}major}$ is typically negligible compared to $I_{ds\text{-}minor}$. It is apparent from FIG. 8 that, in subthreshold, $V_{GS}$ can either be below $V_{threshold\text{-}extrapolated}$ (which is also equal to $V_{FB}+2\Phi_b$,) but above $V_{FB}$, or, $V_{GS}$ can be equal to or slightly above $V_{threshold\text{-}extrapolated}$, by as much as 100 mV or more.

For a typical NMOS transistor (whether or not its drain and gate are connected together), the logarithm of the channel current will be substantially proportional to the gate-to-source voltage $V_{GS}$, for values of $V_{GS}$ above $V_{threshold\text{-}extrapolated}$ but below a transition voltage ("$V_{strong\text{-}inversion}$" in FIG. 8). $V_{strong\text{-}inversion}$ is defined as ($V_{threshold\text{-}extrapolated}$+≈100 mV) At such values of $V_{GS}$, the device is said to be operating in "near subthreshold." The logarithm of the channel current for said device when operating with a gate-to-source voltage greater than $V_{FB}$ but less than $V_{threshold\text{-}extrapolated}$ will be exponentially proportional to $V_{GS}$ and the device is said to be operating in "deep subthreshold."

As defined above, the "transconductance" of a MOSFET transistor is the change in the channel current in response to a unit change in gate-to-source voltage $V_{GS}$. It is well known that the transconductance ($g_m$) of a transistor operating in subthreshold is typically very high. This desirable characteristic of subthreshold operation could be exploited in a wide variety of applications if subthreshold operation could reliably be maintained. Although it had been known that MOSFETs (and other transistors) can exhibit in subthreshold a high level of transconductance $g_m$, it had not been known how reliably to maintain a transconducting cell in subthreshold operation until the present invention.

SUMMARY OF THE INVENTION

Aspects of the invention are methods and circuits for reliably biasing one or more transconducting cells to operate in a subthreshold state so as to have a desired high transconductance, and systems including a master cell for generating a regulated bias voltage and one or more transconducting slave cells biased for subthreshold operation by the regulated bias voltage.

Preferred embodiments of the invention are methods and circuits for programming subthreshold current densities in transconducting slave cells by biasing each slave cell with a bias voltage whose value is independent of process and environmental variations (so that the subthreshold current density in the slave cell remains fixed despite supply voltage variations and other process and environmental variations), and circuits for generating such a bias voltage. The bias voltage is generated by servoing an unregulated supply voltage so that the bias voltage has lower magnitude (relative to ground potential) than the supply voltage. The reduced-magnitude, regulated bias voltage precisely regulates at least one transistor in each slave cell by forcing a constant current density therein, thereby causing the cell to operate in subthreshold. Due to the process-independent nature of the closed loop servo system inherent in the bias voltage generation circuitry, the bias voltage can be reliably generated with a precise, desired value which forces subthreshold operation of each slave cell, and this precise bias voltage can be reliably distributed to multiple slave cells.

The invention can be implemented as a voltage amplifier that offers low power consumption, low noise, good stability, and high gain. The amplifier can include a conventional transconducting slave cell of a type conventionally used in nonlinear applications as an inverter, and a master cell which provides a regulated bias voltage to the slave cell (in response to an unregulated supply voltage) to bias the slave cell in subthreshold independent of process or environmental variations.

In a class of preferred embodiments, the inventive system includes a constant current density voltage generator (a master cell whose function is to assert a regulated bias voltage $V_M$ in response to an unregulated supply voltage), and at least one inverting, transconducting slave cell that is biased in subthreshold by the bias voltage. Some such embodiments include a current boosting voltage follower (connected between the voltage generator and each transconducting cell) having an input to which the bias voltage is asserted and an output coupled to the slave cell or cells. The current boosting voltage follower is capable of sourcing current to each slave cell such that its output remains at the bias voltage even when substantial current is sourced therefrom by the slave cell or cells. A current boosting voltage follower will often be needed when multiple slave cells are biased by the generator, or when the output of the generator (if directly connected to the slave cell or cells) would otherwise be loaded to a degree that the bias voltage would deviate from its unloaded value. The generator is designed so that the bias voltage has a value that determines a desired (and preferably optimal) power/noise/stability regime for each slave cell biased thereby.

In this class of preferred embodiments, the voltage generator generates the bias voltage by lowering ("subregulating") the unregulated supply voltage, and a constant current density is maintained in a transistor pair of the voltage generator. The constant current density maintained in the voltage generator is replicated in each transconducting slave cell biased by the bias voltage. The value of the bias voltage applied to each slave cell and the value of the constant current density are sufficiently low to cause subthreshold operation of at least one transistor in each slave cell, and the low bias voltage results in low (but repeatable and reliable) current through the channel of each such slave transistor in response to each particular value of the transistor's gate-to-source voltage.

Preferably, but not necessarily, each slave cell transistor biased to operate in subthreshold is fabricated to have a much larger area (and channel width-to-length ratio) than would be typical if it were intended for normal, non-subthreshold operation, so that there is a very low constant current density in each such transistor during subthreshold operation of the slave cell. The very low constant current density replicated in each slave cell is $J_s=I_S/A_s$, where $I_S$ is the channel current of each slave cell transistor that is biased to operate in subthreshold and $A_s$ is the effective area of the so-biased slave cell transistor or transistors.

Preferred embodiments of the inventive master cell include circuitry (e.g., shunt and series regulator circuitry) configured to provide precise regulation of bias voltage $V_M$ over a wide range of load currents from the slave cell or cells, thus eliminating the need for a current boosting voltage follower between the master cell and the transconducting slave cell(s).

Preferred embodiments of the inventive slave cell have multiple stages, of which each stage is a transconducting cell biased (during operation) in subthreshold in accordance with the invention. In some such embodiments, the slave cell is an integrator which includes multiple inverter stages and at least one feedback stage for providing displacement current to one of the inverter stages. Other embodiments of the inventive slave cell include two pairs of cascoded transistors. Other embodiments of the inventive slave cell include an NMOS transistor and a PMOS transistor biased in subthreshold, but whose gate potentials are offset by different amounts above and below an input voltage.

DETAILED DESCRIPTION OF THE PREFERRED EMBODIMENTS

Figure 1:
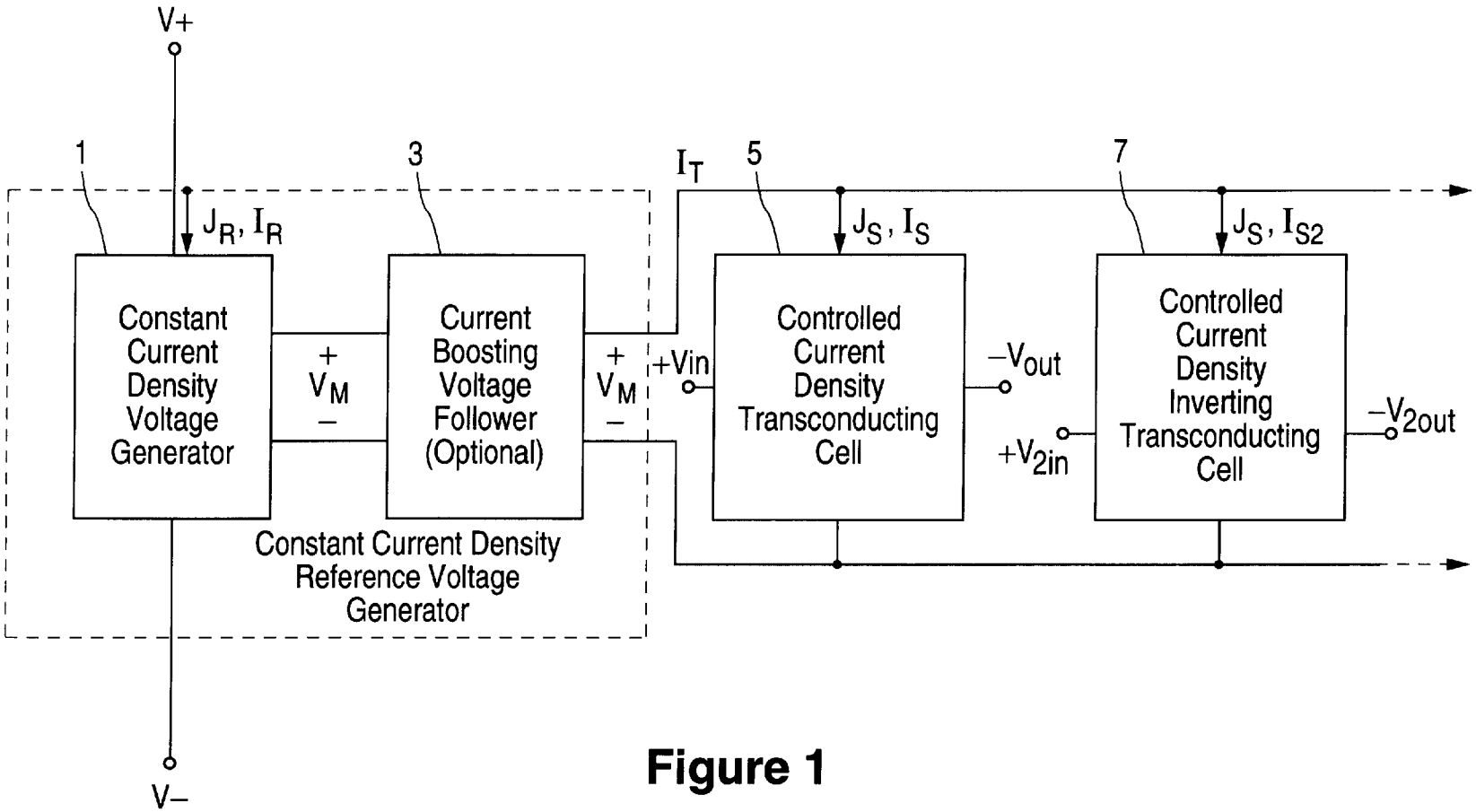
FIG. 1 is a block diagram of a preferred embodiment of the system of the invention.

FIG. 1 is a block diagram of a preferred embodiment of the inventive system. The FIG. 1 system includes constant current density voltage generator 1, inverting transconducting cells 5 and 7 (and optionally also additional inverting transconducting cells connected in parallel with cells 5 and 7), and current boosting voltage follower 3 connected between voltage generator 1 and each of the transconducting cells (including cells 5 and 7). Voltage generator 1 asserts regulated bias voltage $V_M$ in response to unregulated supply voltage $(V+)-(V-)=V_{dd}$. The supply voltage Vdd is typically supplied by a battery and is typically equal to about three or five volts. Also typically, the FIG. 1 circuit is implemented as an integrated circuit (or a portion of an integrated circuit) and the potential "V−" is ground potential for the integrated circuit. Current boosting voltage follower 3 receives bias voltage $V_M$ from generator 1, and asserts a bias voltage having the same magnitude ($V_M$) across each of cells 5 and 7 (and each other cell connected in parallel with cells 5 and 7).

Cell 5 draws current $I_S$, cell 7 draws current $I_{S2}$, and each other cell connected in parallel with cells 5 and 7 draws a current from voltage follower 3. Voltage follower 3 is configured to source the total current $I_T$ drawn by cells 5 and 7 (and each other cell connected in parallel therewith), and to assert the regulated bias voltage $V_M$ across each of the cells (including cells 5 and 7) even when a substantial total current $I_T$ is drawn from circuit 3 by all the cells.

When biased to operate in subthreshold by bias voltage $V_M$, cell 5 asserts output voltage $-V_{out}$ in response to input voltage $V_{in}$, and cell 7 asserts output voltage $-V_{2out}$ in response to input voltage $V_{2in}$. When so biased in subthreshold, each cell's transconductance is high in the sense that there is a relatively large change in channel current of at least one transistor in the cell (in turn causing a relatively large change in the cell's output voltage) in response to a much smaller change in the cell's input voltage (which input voltage determines a gate-to-source voltage of at least one transistor operating in subthreshold in the cell).

Each of cells 5 and 7 is an inverting transconducting cell, and thus the negative signs of "$-V_{out}$" and "$-V_{2out}$" indicate that voltages $-V_{out}$ and $V_{in}$ have opposite sign (with respect to some reference voltage), voltages $-V_{2out}$ and $V_{2in}$ have opposite sign (with respect to some reference voltage), $-V_{out}$ decreases in response to increasing input voltage $V_{in}$ (and $-V_{out}$ increases in response to decreasing $V_{in}$), and $-V_{2out}$ decreases in response to increasing input voltage $V_{2in}$ (and $-V_{2out}$ increases in response to decreasing $V_{2in}$).

Each cell biased by generator 1 (e.g., cell 5 and cell 7) is sometimes denoted herein as a "slave" cell. Generator 1 is sometimes denoted herein as a "master" cell.

Generator 1 is designed so that bias voltage $V_M$ has a value that determines a desired (and preferably optimal) power/noise/stability regime for each slave cell. In particular, each slave cell includes at least one transistor biased by voltage $V_M$ to operate in a subthreshold state so as to have high transconductance (and preferably to cause the slave cell to have high transconductance). For example, in the preferred embodiment of slave cell 5 shown in FIG. 2, the slave cell includes a CMOS inverter comprising PMOS transistor P2 and NMOS transistor N2, each of which transistor is biased by voltage $V_M$ to operate in a subthreshold state so that the inverter has high transconductance.

With reference again to FIG. 1, generator 1 provides regulation in the sense that voltage $V_M$ is constant despite significant variations in Vdd. Generator 1 preferably generates $V_M$ so as to bias the operating point of each slave cell to a subthreshold state which achieves optimum transconductance per unit current.

Generator 1 includes a transistor pair in which a constant current density $J_R$ is maintained. Each of slave cells 5 and 7 includes at least one transistor in which constant current density $J_R$ is replicated (the channel current density of such transistor is $J_S=J_R$). The circuit is implemented so that the value $J_S=J_R$ is sufficiently low (and the value of voltage $V_M$ is such) that each such slave cell transistor is biased to operate in subthreshold by regulated voltage $V_M$. By so replicating a constant current density in each slave cell, each slave cell of the FIG. 1 system draws (in repeatable and reliable fashion) a low, constant current through the channel of at least one transistor therein and each such transistor is reliably biased to operate in a subthreshold state.

Figure 2:
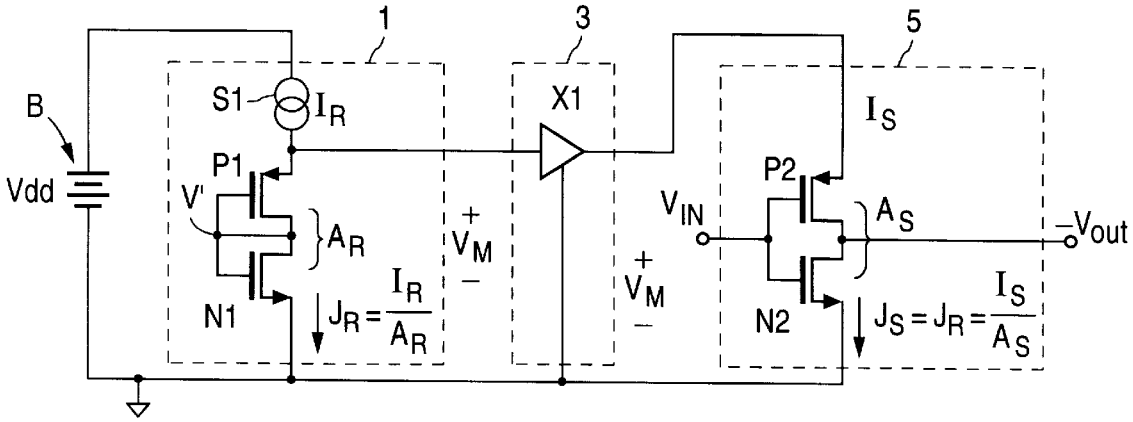
FIG. 2 is a schematic diagram of an implementation of a variation on the system of FIG. 1 which includes a single transconducting slave cell (circuit 5) implemented using CMOS technology.

For each slave cell transistor biased in subthreshold by voltage $V_M$, the channel current (e.g., $I_S$ or $I_{S2}$ in FIG. 1) is very low (e.g., 10 microAmps for the FIG. 2 embodiment of cell 5). Preferably, each such transistor is fabricated with a much larger channel width-to-length ratio (w/l ratio) than would be typical if the transistor were intended for normal, non-subthreshold operation. To replicate the (low) master cell channel current density ($J_R$) in such transistors in accordance with the invention with a typical channel current level in the slave cell, it is usually desirable that the transistors have large channel width-to-length ratios. The constant current density replicated in each slave cell that is biased to operate in subthreshold is $J_R=J_S=I_{si}/A_{si}$, where $I_{si}$ is the channel current through the slave cell during subthreshold operation, $A_{si}$ is the effective area (determined by the effective channel width-to-length ratio) of the transistor or set of transistors of the slave cell which operate in subthreshold, and "i" is an index identifying the slave cell. This constant current density is very low during subthreshold operation of the slave cell.

In preferred embodiments (such as that of FIG. 2), each slave cell includes a CMOS inverter. The slave cell may include only such a CMOS inverter, or it may include a CMOS inverter together with circuitry providing feedback between the inverter's input and output. For example, the slave cell might implement an integrator comprising a CMOS inverter and feedback circuitry (including a capacitor) between the inverter's input and output.

In alternative embodiments, at least one of the slave cells includes no CMOS inverter. For example, at least one of the transconducting cells can include a single MOS transistor coupled with a current source. One such embodiment of the transconducting cell includes a PMOS transistor whose source receives the bias voltage $V_M$ and whose drain is coupled to a current source (the current source being coupled between the PMOS transistor's channel and ground). The gate of such PMOS transistor is the input terminal of the cell and the drain is the output terminal of the cell.

FIG. 2 is a schematic diagram of a preferred implementation of a variation on the system of FIG. 1 which includes only one slave cell 5, and which is implemented with CMOS devices. With reference to FIG. 2, battery B supplies voltage $V_{dd}$ across generator 1. Generator 1 comprises current source S1 (which is a source of fixed current $I_R$) connected in series with PMOS transistor P1 and NMOS transistor N1. Since it is well known how to design a source of fixed current $I_R$ that would be suitable for use in the FIG. 2 system, the details of such design are not discussed herein. The channels of transistors P1 and N1 are connected in series. In essence, transistors P1 and N1 comprise an inverter with its input shorted with its output. Each of transistors P1 and N1 is diode connected so that the common gates of P1 and N1 are connected to the common drains of P1 and N1, the source of P1 is connected to one terminal of current source S1, and the source of N1 is connected to ground. Battery B is connected between ground and the other terminal of current source S1 as shown.

Bias voltage $V_M$, asserted across current boosting voltage follower 3 by generator 1, is the sum of the gate-to-source voltages of transistors P1 and N1. The sum of these gate-to-source voltages includes the threshold voltages of devices P1 and N1 and the portion of each gate to source voltage which is in excess of (or less than) the threshold voltage.

The constant channel current density $J_R$ of transistors P1 and N1 is determined by the current $I_R$from the current source, and the effective area $A_R$ of transistors P1 and N1, according to: $J_R=I_R/A_R$. The effective area $A_R$ is in turn determined by the effective channel width-to-length ratio of transistors P1 and N1. Preferably, each of transistors P1 and N1 is fabricated to have a much larger area than would be typical if it were intended for normal, non-subthreshold operation (preferably, the channel width of each is much greater than the typical width for non-subthreshold operation), so that there is a very low constant current density in each of transistors P1 and N1 during subthreshold operation. Similarly, each of transistors P2 and N2 in slave cell 5 is preferably fabricated to have a much larger area than would be typical if it were intended for normal, non-subthreshold operation, so that the constant current density replicated in each of transistors P2 and N2 during subthreshold operation of the slave cell is a very low current density.

In slave cell 5, PMOS transistor P2 and NMOS transistor N2 comprise a CMOS inverter. The input terminal for the cell is the common gates of P2 and N2. The source of P2 is connected to the output terminal of voltage follower 3 (and is thus held at bias voltage $V_M$ above ground), the drain of P2 is connected to the drain of N2, and the source of N2 is connected to ground. The common drains of N2 and P2 comprise the output terminal of cell 5. The common gates of P2 and N2 receive input voltage $V_{in}$, and the common drains of P2 and N2 are at output voltage $V_{out}$. Typically, circuitry (not shown) would be connected between the common gates of P2 and N2 (the inverter's input) and the common drains of P2 and N2 (the inverter's output), to provide feedback between the inverter's input and output. For example, slave cell 5 of FIG. 2 might implement an integrator comprising the CMOS inverter (shown in FIG. 2) and feedback circuitry (not shown) including a capacitor between the inverter's input and output.

Current boosting voltage follower 3 receives bias voltage $V_M$ from generator 1, and asserts a bias voltage having the same magnitude ($V_M$) across cell 5 to bias transistors P2 and N2 to operate in subthreshold. Cell 5 draws current $I_S$ from voltage follower 3, and transistors P2 and N2 have effective area $A_S$, such that the effective channel current density $J_S$ of transistors P2 and N2 replicates the effective channel current density $J_R$ of master cell 1: $I_S=J_SA_S=J_RA_S$.

In generator 1 (sometimes referred to as "master" cell 1), the drain voltage of transistors N1 and P1 is fixed by the diode connection (the drain to gate connection) for each device, so that $V_{DS}=V_{GS}$ for each device. The characteristics of transistors N1 and P1 (including their effective area $A_R$) and the value of $I_R$ should be chosen to set $V_M$ to the desired level for causing slave cell transistors P2 and N2 to operate in subthreshold. Given a particular value of current $I_R$, the constant channel current density $J_R$ of devices P1 and N1 (which is replicated in transistors P2 and N2 of slave cell 5) is determined by the effective channel width-to-length ratio of devices P1 and N1. In a typical implementation, $V_M$ is 1.5 volts (where the threshold voltage of each of slave cell transistors P2 and N2 is 0.7 volts). Thus, slave cell transistor P2 is biased by voltage $V_M$ to operate in subthreshold with a $V_{GS}$ of 0.75 volts and slave cell transistor N2 is also biased by voltage $V_M$ to operate in subthreshold with a $V_{GS}$ of 0.75 volts. More typically (because of differences between transistors P2 and N2), transistors P2 and N2 are not exactly symmetrical and the voltage $V_{in}$ is not exactly $V_M/2$.

If, for slave cell 5 (or any other slave cell connected to the output of voltage follower 3 in parallel with cell 5), input voltage $V_{in}$ is floating and output voltage $-V_{out}$ is within the range resulting from normal subthreshold operation of slave cell transistors P2 and N2 (i.e., assuming that the output voltage $-V_{out}$ is not at a level which would starve the drain of N2 or P2), then the input voltage $V_{in}$ will always be equal to the voltage V' at the equivalent node (the common gates of P1 and N1) in master cell 1. The explanation for this is as follows. One condition for use of slave cell 5 (where there is no static DC load current at the output of cell 5, which will typically be the case) is that the drain currents of PMOS device P2 and NMOS device N2 are equal. When that is true, since the sum of the gate-to-source voltages ($VGS_{P2}$ and $VGS_{N2}$) of transistors P2 and N2 is $V_M$, it follows that voltage $V_{in}$ at the input of cell 5 is equal to voltage V' at the equivalent node of master cell 1.

In the usual case that the input voltage $V_{in}$ of slave cell 5 is driven, cell 5 operates as a high-gain comparator if there is no feedback between cell 5's output terminal and input terminal. In this case its transfer function would ideally be as follows: cell 5's output voltage $-V_{out}$ would go to $V_M$ in response to input voltage $V_{in}$ less than V' (where V' is the voltage at the common gates of master cell transistors N1 and P1), and output voltage $-V_{out}$ would go to ground in response to input voltage $V_{in}$ greater than V'. With real (non-ideal) implementations of the circuit, the transfer function would have finite gain in the transition region (the region in which voltage $V_{in}$ is near to V').

If there is a feedback circuit connected between the output and the input of cell 5 so that cell 5 implements a function determined by the feedback circuit (e.g., that of a fixed-gain amplifier or other amplifier, or an integrator), then as long as such function is not overdriven, the input voltage $V_{in}$ will strive to be equal to voltage V' (the voltage at the common gates of master cell 1) in the idealized case. With real (non-ideal) implementations of the circuit in which the transfer function of slave cell 5 has finite gain, when the slave cell's output voltage $-V_{out}$ changes away from the existing value of input voltage $V_{in}$ on the input terminal, the cell's available gain with feedback forces voltage $V_{in}$ on the input terminal to remain close to V' (so that the cell together with the feedback circuit remains in an operating region having a desired high gain, and the transistors within the cell remain in the subthreshold state).

In typical implementations, slave cell 5 of FIG. 2 has a gain in the range from fifty to several hundred. In embodiments of the invention that include a cascoded implementation of a transconducting slave cell (e.g., the slave cell shown in FIG. 4), the slave cell can be implemented to have voltage gain as high as 100,000 or even higher.

In one contemplated application, a feedback circuit connected between the input and output of slave cell 5 includes a capacitor and a reset switch connected across the capacitor, to implement an integrator function. When the reset switch is open, any of the signal currents entering into the cell's input terminal would cause the voltage across the feedback capacitor to change, and therefore the voltage at the cell's output terminal would vary accordingly within the dynamic range of the cell. Other functions that can be implemented with different feedback circuits include fixed gain amplifiers, comparators, and level translators. In all cases, the slave cell is reliably biased in subthreshold in accordance with the invention, and the combined feedback circuit and slave cell thus operates with high gain, with its output voltage within the linear range of the slave cell's transfer function. Accordingly, the transconductance and voltage gain of the combined feedback circuit and slave cell is optimal.

The main feature of subthreshold operation of each transconducting slave cell in accordance with the invention is that the cell's transconductance can be substantially higher than is achievable if the cell operates other than in subthreshold, so that everything that the transconductance affects (e.g., bandwidth) is improved. The current density in each slave cell transistor operating in subthreshold is very small.

In each transconducting slave cell of each embodiment of the inventive system implemented with CMOS technology (e.g., the FIG. 2 system), the gate-to-source voltages required for subthreshold operation must be accurately set in order to accurately bias the two transistors of a CMOS inverter in the cell to their correct current level for subthreshold operation. The bias voltage $V_M$ generated in the master cell produces exactly the slave cell gate-to-source voltages which achieve the desired low-current, subthreshold slave cell operation. When the gate-to-source voltage of either slave cell transistor is varied in the vicinity of its extrapolated threshold voltage (e.g., within a hundred millivolts of the extrapolated threshold voltage), the transistor's sensitivity to the variation in the gate-to-source voltage is extreme. So, the very property that results in large change in channel current for small change in gate-to-source voltage (i.e., transconductance), requires extremely accurate control of the bias voltage $V_M$ (the value of $V_M$ is the sum of the gate-to-source voltages of the two transistors of the slave cell CMOS inverter). An important reason why the invention represents a significant advance over the prior art is that it provides such extremely accurate control.

The bias voltage $V_M$ generated by master cell 1 of FIG. 2 can be thought of as the sum of four voltages: $V_M=V_{tn}+V_{gtn}+V_{tp}+V_{gtp}$, where $V_{tn}$ is the threshold voltage of NMOS device N1, $V_{gtn}$ is the "turnon voltage" of device N1 (the part of the gate-to-source voltage in excess of the threshold), $V_{tp}$ is the threshold voltage of PMOS device P1, and $V_{gtp}$ is the "turnon voltage" of device P1. The two threshold terms ($V_{tn}$, $V_{tp}$) are not controlled during operation, and are instead a function of process and environment. One function of the inventive master cell is to insulate the variation in the slave cell channel current $I_S$ from variations in the threshold voltages of master cell transistors P1 and N1.

If the voltage sum ($V_{tn}+V_{gtn}+V_{tp}+V_{gtp}=V_M$) is too large, voltage $V_M$ will not bias any slave cell into subthreshold operation. For example, if voltage $V_M$ is five volts (in typical implementations of FIG. 2 in which each of thresholds $V_{tn}$ and $V_{tp}$ is about 0.7 volts), each of turnon voltages $V_{gtn}$ and $V_{gtp}$ is about 1.8 volts, which is too high for subthreshold operation. In contrast, in one example of operation of such an implementation of FIG. 2 (in which each of $V_{tn}$ and $V_{tp}$ is about 0.7 volts) in accordance with the invention, voltage $V_M$ is 1.5 volts and each of turnon voltages $V_{gtn}$ and $V_{gtp}$ in slave cell 5 is about 0.05 volts, and thus transistors N2 and P2 are in subthreshold. More generally, during operation of typical implementations of the FIG. 2 system in accordance with the invention, each of turnon voltages $V_{gtn}$ and $V_{gtp}$ will be in the range from about 0.01 volts to 0.1 volts. The invention allows assertion of an appropriate bias voltage $V_M$ and accurate replication of such bias voltage across each of one or more slave cells (independent of the threshold voltages of the transistors comprising the master cell and each slave cell, and independent of variations in supply voltage $V_{dd}$.

There are numerous contemplated alternative embodiments of, and variations on, the FIG. 2 embodiment of the inventive system. Several of these will next be described.

A second CMOS inverter could be included in the slave cell in parallel with the inverter comprising transistors P2 and N2. In such a variation on slave cell 5 of FIG. 2, the cell would draw twice as much current from voltage follower 5 than does cell 5, but each of the four transistors in the two inverters of the slave cell would have the same current density as exists in the master cell transistors (e.g., transistors P1 and N1 of FIG. 2). Conversely, by reducing the effective channel width-to-length ratio of inverter P2,N2 of FIG. 2, the so-modified slave cell could operate at lower channel current (but each of the transistors in the slave cell inverters would have the same current density as in the master cell transistors).

More generally, while keeping current densities $J_R=J_S$ unchanged, the ratio of slave cell current $I_S$ to master cell current $I_R$ of the FIG. 2 circuit is easily changeable by fabricating the circuit with transistors N2 and P2 of different sizes (i.e., different effective channel width-to-length ratios). If one master cell biases multiple slave cells, which will often be the practice, there could be one slave cell with channel current $I_{S1}=I_R$, another slave cell with channel current $I_{S2}=I_R/2$, and so on.

In other variations on the FIG. 2 circuit, the master cell current density $J_R$ and the slave cell current density $J_S$ are substantially different (although both are constant, and the master cell current density determines the slave cell current density). To implement such variations, voltage follower circuit 3 would be replaced by circuitry which adds a constant offset voltage $V_o$ to the constant bias voltage $V_M$, so that the slave cell is biased to operate in subthreshold by voltage $V_o+V_M$ (rather than by voltage $V_M$ alone). Such circuitry could comprise a voltage source having an input coupled to the output of the master cell, and a unity gain voltage follower (identical to circuit 3 of FIG. 2) having an input coupled to the output of the voltage source. Depending on the value of the constant offset voltage $V_o$, slave cell current density $J_S$ could be greater than or less than master cell current density $J_R$. As the ratio at nominal conditions of $J_S$ to $J_R$ deviates far from unity (e.g., to $J_S/J_R$=10/1 or 5/1), then the tracking of the slave and the master becomes less and less accurate, and more subject to process variation (although not to supply voltage variation) This sensitivity to process variation is expected to increase somewhat slowly with $V_o$, so that when $V_o$ is zero there is minimum sensitivity to process variation, and as long as $V_o$ remains less than some significant voltage (e.g., voltage V' at the common gates of the master cell inverter) there may be adequately low sensitivity to process variation for some applications.

Other variations on the embodiments of FIG. 2 and FIG. 1 omit a power-consuming unity gain current boosting voltage follower (e.g., they omit voltage follower 3 of FIGS. 1 and 2, which would typically need to be provided with some supply voltage). For example, where master cell channel current $I_R$ is quite large, and the sizing (effective channel width-to-length ratio) of the master cell transistors N1 and P1 is also quite large, and then the slave cell transistors could have substantially smaller channel width-to-length ratio so that their channel currents $I_{S1}$ would be a small fraction of $I_R$. In this case, one could actually operate multiple slave cells at fractional currents (fractional values of $I_R$) by omitting the voltage follower (e.g., omitting voltage follower 3) and replacing it with just a wire.

The efficiency of the inventive slave cell (operating in subthreshold) is determined by a "figure of merit." For a single MOS transistor, a figure of merit $V_H$ is defined to be $I_S/g_m$ (where $g_m$ is the transconductance and $I_S$ is the channel current) which is approximately equal to $KT/q+(V_{gtp})/2$ when the transistor is in subthreshold operation (as well as when it is in strong inversion). The first term is derived from differentiating $I_{ds\text{-}minor}$, and the second term is derived from differentiating $I_{ds\text{-}major}$, with respect to $V_{GS}$. Thus, to improve the transconductance per unit current, one would minimize $V_H$ by minimizing $V_{gtp}$.

A similar "figure of merit" for the inventive slave cell of FIG. 2 (cell 5 operating in subthreshold) is $V_{Hic}=KT/2q+(V_{gtp}\|V_{gtn})/2$, where the symbol "‖" is defined as follows: A‖B denotes A is "in parallel with" B so that A‖B=A*B/A+B=1/[(1/A)+(1/B)]. The combined transconductances of the two transistors of the FIG. 2 slave cell result in an effective figure of merit better than that of each individual one of the transistors.

Just as a single transistor has a defined relationship of channel current and transconductance, the combined operation of the two devices in inverting slave cell 5 of FIG. 2 has its own such relationship. For operation of the FIG. 2 embodiment with the gate of each of transistors N2 and P2 at a turnon voltage of $V_{gtp}=V_{gtn}$=50 mV (where $V_{gtn}$ is the turnon voltage for N2, and $V_{gtp}$ is the turnon voltage for P2) beyond the threshold voltage at typical temperature (such threshold voltage is typically 0.7 volts), the figure of merit $V_{Hic}$ is about 26 mV. Thus, at $I_S$=10 microAmps, the FIG. 2 embodiment achieves a value of $1/g_m$ of 2600 Ohms (which is a very low impedance and high $g_m$ for such a small current, for any circuit). It is important to realize that cell 5 is a complete amplifier; not just a stage within a complete amplifier. In general, the turnon voltages $V_{gtn}$ and $V_{gtp}$ of typical implementations of the FIG. 2 system will be in the range from 25 mV (or less) to 100 mV and the corresponding figures of merit, $V_{Hic}$, achieved would range from about 19.25 mV to 38 mV. For a single MOS device operating at a $V_{gtn}$ or $V_{gtp}$ of 1.8 volts, $V_{Hic}$ would be about 0.926 volts. It is interesting to note that the best $V_{Hic}$ that a single bipolar transistor could achieve (at room temperature) is 26 mV.

Figure 3:
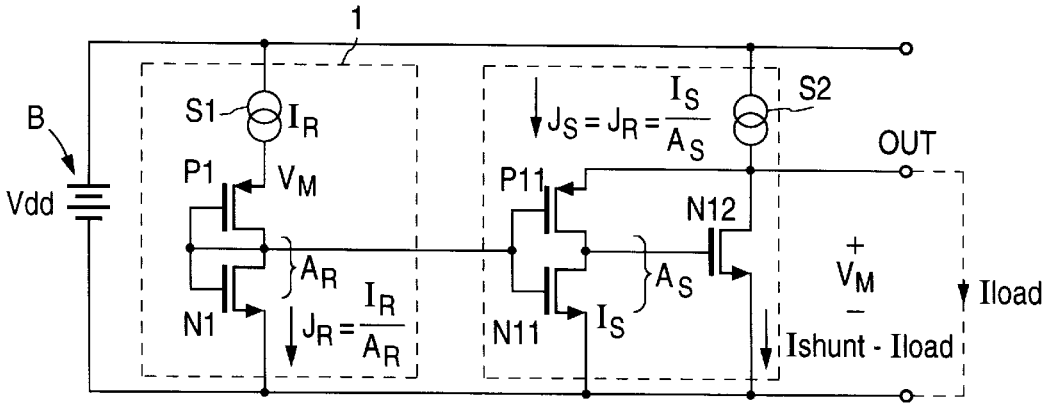
FIG. 3 is a schematic diagram of an alternative circuit which can replace master cell 1 and voltage follower 3 of FIG. 2, and which generates a regulated bias voltage for use in biasing one or more transconducting slave cells.

FIG. 3 is a schematic diagram of an alternative embodiment of the inventive master cell. The master cell of FIG. 3 replaces the elements of the FIG. 2 circuit other than slave cell 5, and generates regulated bias voltage $V_M$ which can be used to bias one or more transconducting slave cells (e.g., cell 5 of FIG. 2). Battery B and circuit block 1 of the FIG. 3 circuit are identical to the corresponding elements of FIG. 2 (which are identically labeled in FIGS. 2 and 3), and the description thereof will not be repeated. The common drains of transistors P1 and N1 (within block 1) are coupled to the common gates of PMOS transistor P11 and NMOS transistor N11. Transistors P11 and N11 comprise a CMOS inverter whose output (the common drains of P11 and N11) is coupled to the gate of NMOS transistor N12. Current source S2 (which is a source of fixed current $I_{shunt}+I_S$) is connected between the positive terminal of battery B, and the output node (to which the source of P11 and the drain of N12 are connected), so that the sum of the channel currents through P11 and N12 is equal to $I_{shunt}-I_{load}+I_S$. Transistors P11 and N11 are sized (with effective area $A_S$) so that the current density in their channel ($J_S=I_S/A_S$, where $I_S$ is the channel current through P11) is equal to the current density of P1 and N1 ($J_R=I_R/A_R=J_S$). This configuration forces the output node (the common source of P11 and drain of N12) to remain stably at the bias voltage $V_M$ above ground, even with variable load current $I_{load}$ being drawn from the output node (by the transconducting slave cell or cells connected between the output node and ground). If load current $I_{load}$ changes (thus tending to change the gate-to-source voltage of transistor P11 and thus the voltage $V_M$), there will be a compensating change in the drain-to-source voltage of transistor N12 which tends to restore voltage $V_M$ to its equilibrium value (the value which balances transistors P11 and N11). For example, if $I_{load}$ increases, this initially decreases the gate-to source voltage of P11, which in turn increases the potential at the gate of transistor N12, which In turn increases the drain-to-source voltage of N12, which raises the potential at the output terminal (thus compensating for the initial drop in the potential $V_M$ at the output terminal).

Design of the FIG. 3 circuit requires prior knowledge of the maximum value of $I_{load}$ expected during operation, so that the current source $I_{shunt}$ can be designed to supply shunt current $I_{shunt}$ sufficiently greater than the maximum load current to allow the circuit to operate as described ($I_{shunt}$ will typically be greater than the maximum load current $I_{load}$ by a factor of 1.25 or 1.5). An improved version of the FIG. 3 circuit, which is not subject to this constraint, will be described below with reference to FIG. 11.

Figure 4:
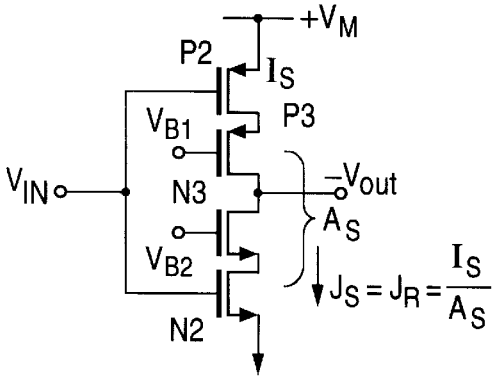
FIG. 4 is a schematic diagram of an alternative embodiment of the inventive transconducting cell, which can replace cell 5 of FIG. 2.

The transconducting inverting slave cell circuit of FIG. 4 is a variation on the slave cell of FIG. 2. The FIG. 4 cell employs two pairs of cascoded MOSFET transistors in order to reduce to negligible values the gate-to-drain parasitic capacitances (such parasitic capacitances may be non-negligible in the FIG. 2 embodiment). It is intended that the FIG. 4 circuit is biased by regulated bias voltage $V_M$ which can be generated by any embodiment of the inventive master cell. The FIG. 4 cell is capable of achieving higher bandwidth than is the slave cell of FIG. 2.

With reference to FIG. 4, the source of PMOS transistor P2 is held at bias voltage $V_M$, the drain of P2 is coupled to the source of PMOS transistor P3, the drain of P3 is coupled to the drain of NMOS transistor N3, the source of N3 is coupled to the drain of NMOS transistor N2, and the source of N2 is grounded. The three inputs of FIG. 4 are as follows: the common gates of P2 and N2 receive input voltage $V_{in}$, the gate of P3 receives bias voltage $V_{B1}$, and the gate of N3 receives bias voltage $V_{B2}$.

Preferably, the two bias voltages ($V_{B1}$ and $V_{B2}$) are supplied by the same master cell that supplies bias voltage $V_M$. In one embodiment, such master cell is a modified version of master cell 1 of FIG. 2, having a resistor inserted between the drain of device P1 and the common gates of N1 and P1, another resistor inserted between the drain of device N1 and the common gates of N1 and P1, and lines connected between the resistors and second and third inputs of the slave cell of FIG. 4 for asserting $V_{B1}$ and $V_{B2}$ to these inputs. Thus, bias voltage $V_{B1}$ would be slightly above the voltage V' at the common gate of the master cell, and bias voltage $V_{B2}$ would be slightly below voltage V'. The drop across one resistor in the master cell is replicated as the $V_{ds}$ drop (drain-to-source voltage) across transistor P3, and the drop across the other resistor in the master cell is replicated as the $V_{ds}$ drop across transistor N3. It is desirable to program the drain-to-source voltage of devices P2 and N2 (by appropriately choosing the device sizes and the value of the bias voltage $V_M$) so that the drain-to-source voltage is just above $V_{ds\text{-}sat}$, so that the devices operate (in subthreshold) with minimal variations in drain-to-source voltage (since this achieves higher voltage gain). In operation, the inner devices (P3 and N3) absorb the larger voltage swing. The structure of the FIG. 4 cell allows voltage $V_M$ to bias transistors P2 and N2 in subthreshold, while the output voltage $-V_{out}$ can swing very close to the rails (very close to ground potential or very close to $V_M$) in response to changing values of input voltage $V_{in}$ at the common gates of P2 and N2. The FIG. 4 circuit can be designed so that during operation the drain-to-source voltages of N2 and P2 are very small voltages (which vary only slightly during operation), which minimizes loss in headroom and achieves a very predictable and reliable estimation of what $V_{ds\text{-}sat}$ will be. $V_{ds\text{-}sat}$ varies with process, and the loss in headroom will also vary.

As with any embodiment of the inventive slave cell, feedback circuitry (not shown) can be provided between the input and output of the FIG. 4 cell. The feedback circuitry would be connected between the common gates of P2 and N2 (the input of the FIG. 4 cell) and the common drains of P3 and N3 (the output of the FIG. 4 cell) to provide feedback between the cell's input and output.

Figure 5:
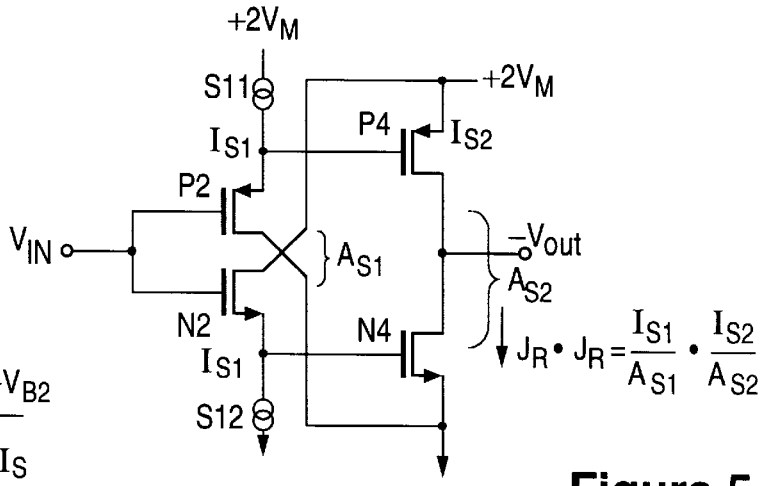
FIG. 5 is a schematic diagram of another alternative embodiment of the inventive transconducting cell, which can replace cell 5 of FIG. 2.

The transconducting inverting slave cell circuit of FIG. 5 is another variation on the slave cell of FIG. 2. The FIG. 5 cell employs two pairs of MOSFET transistors (P2 and N2, and P4 and N4) connected as shown. It is intended that the FIG. 5 circuit is biased by regulated bias voltage $2V_M$ which can be generated by an embodiment of the inventive master cell. Bias voltage $2V_M$ has twice the value of the bias voltage $V_M$ generated in typical implementations of the FIG. 2 system.

With reference to FIG. 5, the source of PMOS transistor P4 is held at bias voltage $2V_M$, the drain of P4 is coupled to the drain of NMOS transistor N4, the source of N4 is grounded, the source of PMOS transistor P2 is coupled to current source S11 and to the gate of P4, the drain of P2 is grounded, the drain of NMOS transistor N2 is held at bias voltage $2V_M$, and the source of N2 is coupled to current source S12 and to the gate of transistor N4. The input of FIG. 5 is the common gates of P2 and N2 which receive input voltage $V_{in}$, and the output is the common drains of P4 and N4.

In the FIG. 5 cell, the channel current $I_{S1}$ of P2 is supplied by current source S11 which itself has regulated bias voltage $2V_M$ as a supply voltage, the channel current of N2 (also equal to $I_{S1}$) is sunk by current source S12, the channel current $I_{S2}$ of P4 and N4 is supplied by connecting the source of device P4 to the master cell (or to a current boosting voltage follower connected to the output of the master cell). Transistors P2, P4, N2, and N4 are sized (with P2 and N2 having effective area $A_{S1}$ and P4 and N4 having effective area $A_{S2}$), and bias voltage $2V_M$ is chosen, so that transistors P2, P4, N2, and N4 are biased in subthreshold. The current density of the inverter comprising transistors P4 and N4 ($J_S$) replicates that in the master cell ($J_R$), and satisfies $$J_S=J_R=((I_{S1}/A_{S1})(I_{S2}/A_{S2})^{1/2}.$$

As with any embodiment of the inventive slave cell, feedback circuitry (not shown) can be provided between the input and output of the FIG. 5 cell. The feedback circuitry would be connected between the common gates of P2 and N2 (the input of the FIG. 5 cell) and the common drains of P4 and N4 (the output of the FIG. 5 cell) to provide feedback between the cell's input and output.

Figure 6:
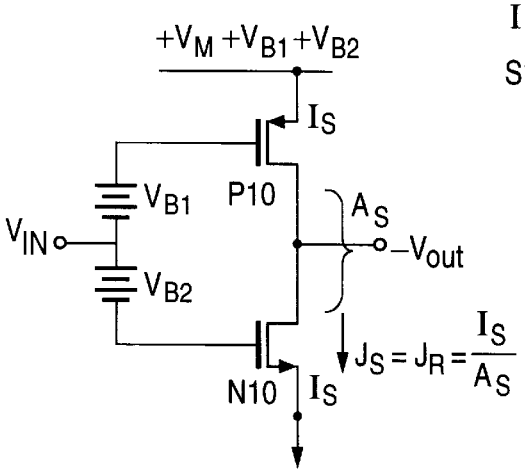
FIG. 6 is a schematic diagram of another alternative embodiment of the inventive transconducting cell, which can replace cell 5 of FIG. 2.

The transconducting inverting slave cell circuit of FIG. 6 is another variation on the slave cell of FIG. 2. The FIG. 6 cell employs a single CMOS inverter (consisting of PMOS transistor P10 and NMOS transistor N10, connected as shown), and operates with P10 and N10 in subthreshold but with the gate of P10 at a different potential than the gate of N10. It is intended that the FIG. 6 circuit is biased by regulated bias voltage $V_M+V_{B1}+V_{B2}$ which can be generated by any embodiment of the inventive master cell, and is greater than the value of bias voltage $V_M$ generated in typical implementations of the FIG. 2 system.

Still with reference to FIG. 6, the gate of P10 is coupled to the cell's input in series with an element across which there is a voltage $V_{B1}$ (e.g., a capacitor), and the gate of N10 is coupled the cell's input in series with another element across which there is a voltage $V_{B2}$ (e.g., another capacitor). The source of transistor P10 is at potential $V_M+V_{B1}+V_{B2}$, the source of transistor N10 is grounded, and the common drains of P10 and N10 are at the cell's output potential ($-V_{out}$). Thus, when the potential $V_{in}$ at the cell's input is floating, the gate of P10 is at potential $V_M/2+V_{B1}/2+V_{B2}/2$, and the gate of N10 is at potential $V_M/2-V_{B1}/2-V_{B2}/2$, and both P10 and N10 operate in subthreshold. In the usual case that the input voltage $V_{in}$ is driven, the cell operates as a high-gain comparator if there is no feedback between the cell output terminal and input terminal. In this case its transfer function would ideally be as follows: output voltage $-V_{out}$ would go to $V_M+V_{B1}+V_{B2}$ in response to input voltage $V_{in}$ less than $V_M/2-V_{B1}/2+V_{B2}/2$, and output voltage $-V_{out}$ would go to ground in response to input voltage $V_{in}$ greater than $V_M/2-V_{B1}/2+V_{B2}/2$. With real (non-ideal) implementations of the circuit, the transfer function would have finite gain in the transition region (the region in which voltage $V_{in}$ is near to $V_M/2-V_{B1}/2+V_{B2}/2$) in which P10 and N10 operate in subthreshold.

In the FIG. 6 cell, the voltages $V_{B1}$ and $V_{B2}$ are preferably produced by capacitors that are charged during a biasing phase, and then maintained in the charged state to provide the offset potentials during subthreshold operation of the cell. In practice, the capacitors would be charged up from a reference cell (not shown) during the biasing phase, and then switched over to the gates of P10 and N10 during active operation of the cell. The capacitors would be periodically recharged during operation to maintain the desired potential difference ($V_{B1}$ or $V_{B2}$) across them. This requires a multiphase dynamic biasing (to dynamically vary all of the biasing voltage $V_M+V_{B1}+V_{B2}$ asserted to the source of P10 from the master cell, and the voltages $V_{B1}$ and $V_{B2}$ between the input terminal and the gates of P10 and N10). Thus, the FIG. 6 circuit is not a statically biased circuit (as are the other described embodiments of the inventive slave cell).

The main advantage of the FIG. 6 embodiment is that it provides a wider swing in the cell output potential ($-V_{out}$) than is available using the FIG. 2 or FIG. 4 embodiment. In one application, during most of the time that the FIG. 6 cell operates, the bias voltage $V_M+V_{B1}+V_{B2}$ asserted to the source of P10 (from the master cell) is not subregulated. In other words, the value of bias voltage $V_M+V_{B1}+V_{B2}$ is usually that of a conventional supply voltage Vdd (e.g., a supply voltage Vdd equal to about five volts) in this application. Only rarely during operation of the FIG. 6 cell (in the example) will the master cell be dynamically controlled to operate in a mode in which the bias voltage $V_M+V_{B1}+V_{B2}$ (asserted by the master cell to the source of P10) is much lower than a conventional supply voltage, so that this low value of the bias voltage biases the FIG. 6 cell into subthreshold operation.

Figure 7:
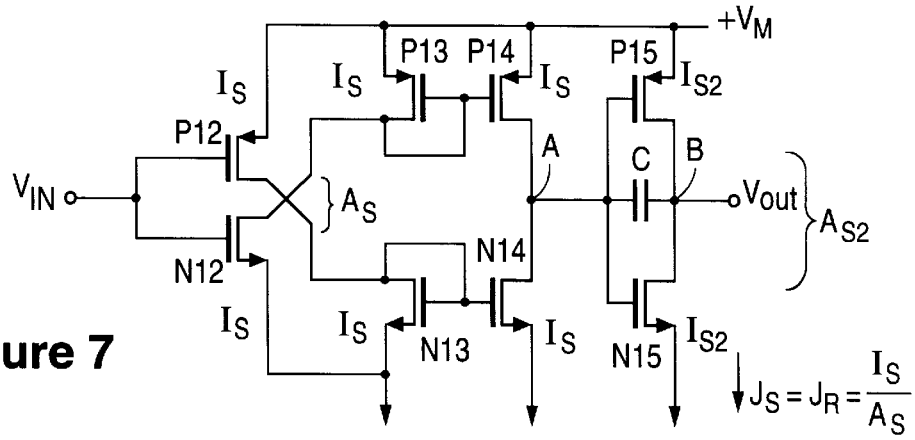
FIG. 7 is a schematic diagram of another alternative embodiment of the inventive transconducting cell (an integrator) which can replace cell 5 of FIG. 2.
Figure 8:
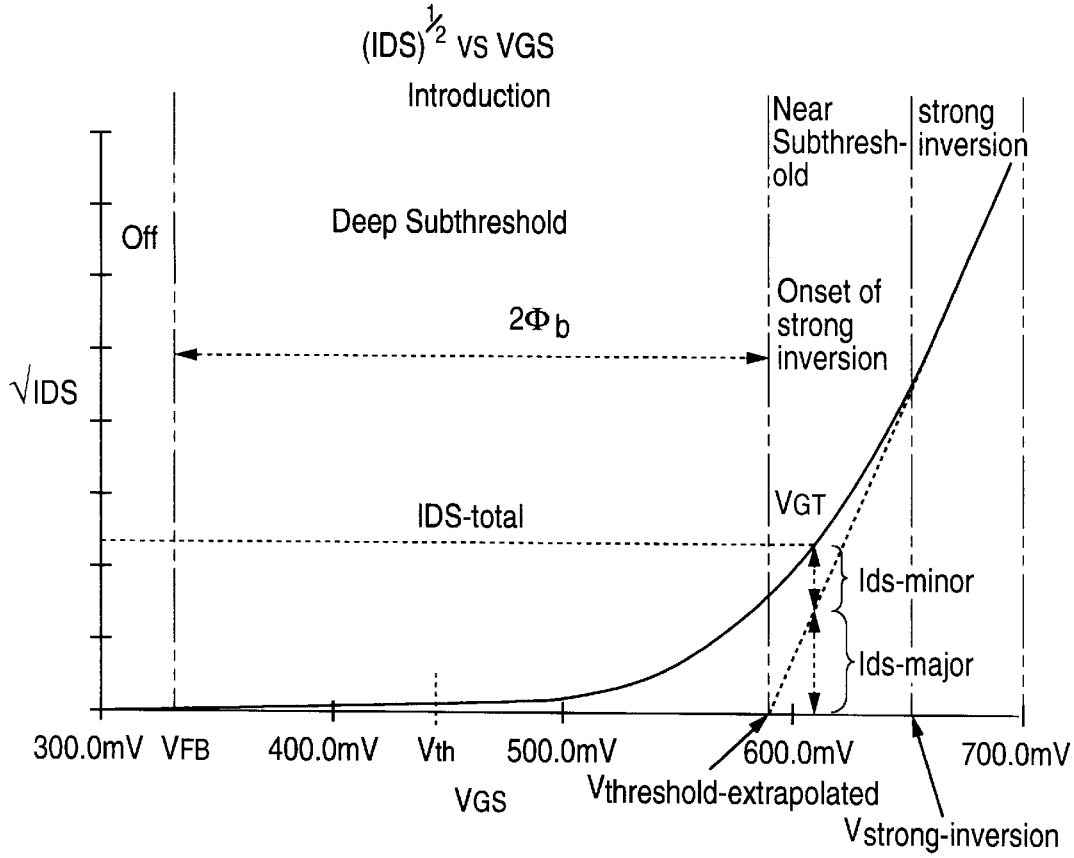
FIG. 8 is a graph representing the square root of drain current $I_d$ of an NMOS transistor whose drain and gate are connected together, as a function of gate-to-source voltage.
Figure 9:
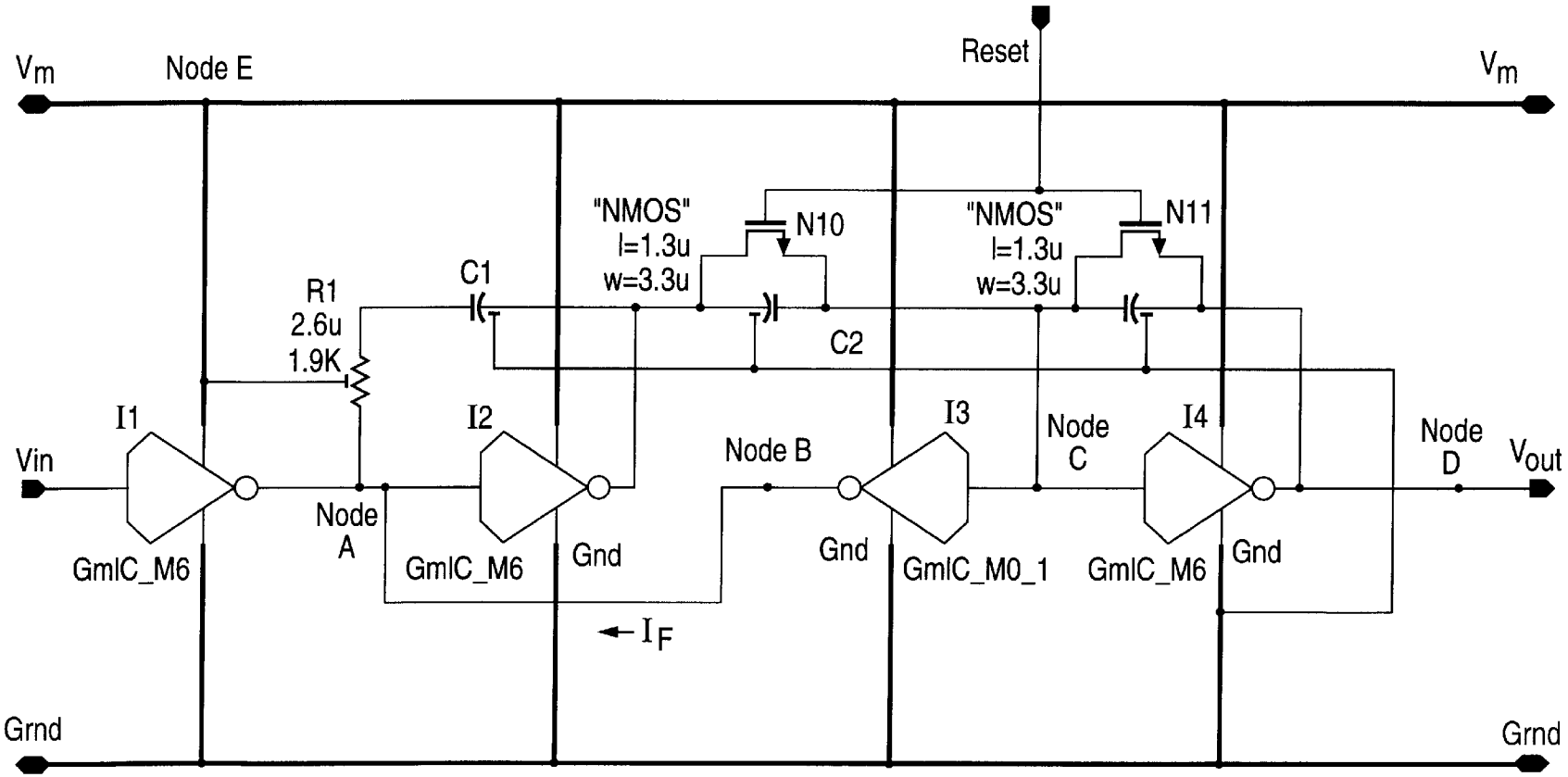
FIG. 9 is a schematic diagram of another embodiment of the inventive transconducting cell (an integrator) which can replace cell 5 of FIG. 2.

We next describe the embodiments of FIGS. 7 and 9. The principal value of each of the FIG. 7 embodiment and the FIG. 9 embodiment of the invention is that each is a multi-stage implementation of a transconducting slave cell designed in accordance with the invention. Each of FIG. 7 and FIG. 9 is a slave cell that is a multi-stage transconducting integrator. The FIG. 9 circuit comprises an initial inverter stage I1, a second inverter stage I2, and a third inverter stage I4 connected in series (with a capacitor connected between the input and output of each of stages I2 and I4 and a capacitor connected between stage I2's output and stage I4's input), and a feedback stage I3 which provides a feedback current to the output of first stage I1.

In FIG. 7, the input voltage $V_{in}$ is received by the common gates of transistors P12 and N12 (which comprise a CMOS inverter). This CMOS inverter has separate outputs (the drain of P12 and the drain of N12) which drive PMOS transistors P13 and P14 and NMOS transistors N13 and N14 (transistors P13, P14, N13, and N14 comprise a 1:1 current mirror circuit connected between input stage P12,N12 and output stage P15,N15). The drains of P12 and N12 are separated (rather than joined as are the drains of P2 and N2 in FIG. 2), with the drain of P12 connected to current mirror NMOS transistors N13 and N14 (connected as shown), and the drain of N12 connected to current mirror PMOS transistors P13 and P14 (connected as shown). The source of each of P12, P13, and P14 (and PMOS transistor P15 to be discussed below) is biased at voltage $V_M$ received from a master cell (not shown) which embodies the invention, and the drain of each of N12, N13, and N14 (and NMOS transistor N15 to be discussed below) is grounded. The drain currents of P12 and N12 (each at least substantially equal to $I_S$) are mirrored by P13, P14, N13, and N14, so that current $I_S$ flows at Node A from the drain of P14 to the drain of N14. Node A is the input to the third stage comprising PMOS transistor P15, NMOS transistor N15, and capacitor C. The gates of P15 and N15 are connected together at Node A. The output of the third stage is Node B (the common drains of P15 and N15) at the right side of capacitor C.

A variation on the FIG. 7 circuit also achieves multistage operation (with two stages rather than three stages) by omitting 1:1 current mirror circuitry P13, P14, N13, and N14, and connecting the drains of P12 and N12 directly to Node A.

The benefits of the FIG. 7 circuit as shown (with 1:1 current mirror circuitry P13, P14, N13, and N14 connected between the first and third stages) include the following: the overall circuit's frequency response is defined by the transconductance (the change in channel current $I_{S2}$ through P15 and N15, in response to a change in gate-to-source voltage $V_{GS}$ at P12 and N12) and the capacitance of capacitor C, but the voltage gain (the change in output voltage $V_{out}$ at Node B in response to a change in input potential $V_{in}$) is the cascade or compound of that of the individual first and third stages. The voltage at Node A need move only by a small amount in order to make the output voltage $V_{out}$ swing by a large amount. To achieve such a small change in the voltage at Node A, the change in voltage $V_{in}$ at the cell's input need only change by a much smaller amount. Thus the FIG. 7 circuit essentially provides the product of the gains of the first stage and the third stage.

The 1:1 current mirror circuitry (P13, P14, N13, and N14) comprising the second stage allows some additional operations. For example, the 1:1 current mirror circuitry can be replaced by alternative current mirror circuitry which implements a ratio of input to output current other than 1:1 (e.g., 10:1, such that if current $I_S$ is drawn from each of P12 and N12, current $10I_S$ flows to ground at Node A. Such current multiplication would increase the combined effective transconductance of the overall circuit.

Capacitor C of FIG. 7 tailors the frequency response of the FIG. 7 circuit so that when feedback is provided from its output to its input (i.e., when a feedback circuit connects output Node B and the input Node at the common gates of P12 and N12), the presence of more than one stage of amplification can be stabilized despite the fact that there are multiple amplifier stages. The FIG. 7 configuration basically splits the transfer function poles (the poles that would have been associated with two cascaded-together slave cells each having the same design as cell 5 of FIG. 2) and pushes one pole toward the origin, and the other out beyond the crossover frequency. The stabilization occurs by placing that crossover at a point where the phase shift through the amplifier is substantially less than 180°.

Still with reference to FIG. 7, omitting the current mirror circuitry (P13, P14, N13, and N14) greatly simplifies the circuit design. One disadvantage of such omission is that it results in only two inverting stages (that of P12 and N12, and that of P15 and N15), which makes the overall circuit non-inverting (rather than inverting). Thus, an additional purpose of the current mirror circuitry is to provide inversion, so there are three inverting stages (and so the overall circuit is inverting).

We next describe the multi-stage transconducting integrator of FIG. 9. The FIG. 9 circuit is an embodiment of the inventive slave cell, and comprises an initial inverter stage I1, a second inverter stage I2, and a third inverter stage I4 connected in series, and a feedback stage I3 which provides a feedback current to the output of first stage I1.

Each of stages I1, I2, I3, and I4 is implemented as one of the embodiments of the inventive transconducting inverting slave cell (e.g., slave cell 5 of FIG. 2), and the source of a transistor in each stage is held at bias voltage $V_M$ which is supplied to Node E from any embodiment of the inventive master cell, optionally through a current boosting voltage follower. NMOS transistors N10 and N11, connected as shown, are normally "off" in response to an appropriate (low) value of the voltage "Reset" at their gates, but can be turned on (in response to a high value of voltage "Reset") to reset the FIG. 9 circuit. The output of I1 is connected to the input of I2 at Node A, the output of I2 is connected in series with capacitors C1 and C2 to the input of I4 (Node C), and the output of I2 is connected in series with capacitor C1 and resistor R1 to the input of I2. The output of I4 (at Node D) is the output voltage ($V_{out}$) of the circuit, and is coupled through capacitor C3 to the input of I4 and through capacitors C3, C2, and C1 to the input of I2. The input of I2 is also coupled to Node E through a portion of resistor R1 as shown.

Feedback stage I3 produces a feedback current ($I_F$) at its output (Node B) which is provided to Node A (the input of stage I2) to supply most of the displacement current needed to move the output voltage of first stage I1 from the equilibrium condition. The output impedance ($R_{o1}$) of stage I1 is finite, and the gain of stage I1 is $g_{m1}R_{o1}$, where $g_{m1}$ is the transconductance of stage I1. The gain of stage I1 is fairly modest in typical implementations of the FIG. 9 circuit.

The voltage swing needed at the output of stage I2 is $\Delta V_{out}2/A_{v2}$. The displacement current needed to achieve this voltage swing is $\Delta V_{out}2/(A_{v2})(R_{o2})$, where $R_{o2}$ is the output impedance of stage I2. Assuming that the voltage swing of final stage I4 is the opposite of that of stage I2, it is true that $\Delta V_{out4}/A_{v4}=-\Delta V_{out2}/A_{v4}$. The third stage I3, which provides positive feedback, produces an output current equal to (gm3) $(-\Delta V_{out2})/A_{v4}$, where $g_{m3}$ is the transconductance of stage I3.

When $\Delta V_{out2}/[(A_{v2})(R_{o2})]=(gm3)(-\Delta V_{out2})/A_{v4}$, a fortuitous event occurs at the summation of stages I1 and I3: nearly all of the displacement current needed to swing the output voltage of stage I1 is supplied by the positive feedback stage I3. This makes the apparent gain of stage I1 nearly infinite. In practice, this cancellation is only a partial one (stage I3 does not provide all of the displacement current needed to swing the output voltage of stage I1), but the excellent predictability of the transconductance of each stage I1, I2, I3, and I4 (due to the inventive design of each such stage) allows for the effect to track well.

A basic advantage of the FIG. 9 design (implementation of an integrator in multiple stages, with displacement current for an earlier stage fed back from the output of a later stage) is that it can achieve very high gain (e.g., 80 dB to 90 dB) using only eight transistors (namely, one CMOS pair in each of the four stages I1, I2, I3, and I4), while being a voltage output amplifier rather than an unbuffered single transconducting cell (e.g., a modified version of cell 5 of FIG. 2 with feedback to implement an integration function).

A bipolar transistor implementation of the invention will next be described with reference to FIG. 10. In essence, a bipolar transistor normally behaves as does a MOSFET transistor when the MOSFET transistor is operating in subthreshold. Subthreshold operation essentially means operation in the logarithmic part of the transfer function (the transfer function relating channel current to gate-to-source or base-to-emitter voltage) instead of square law part of the transfer function, and a bipolar transistor is typically logarithmic over a wide current range (e.g., ten decades of current), whereas a MOSFET is typically logarithmic over only the bottom two decades of its range. Thus the bipolar transistors of slave cell 85 of FIG. 10 (and the cell itself) are described herein as being in subthreshold when bias voltage $V_M$ causes operation of such transistors in a desired subrange of the logarithmic range of their transfer function.

Figure 10:
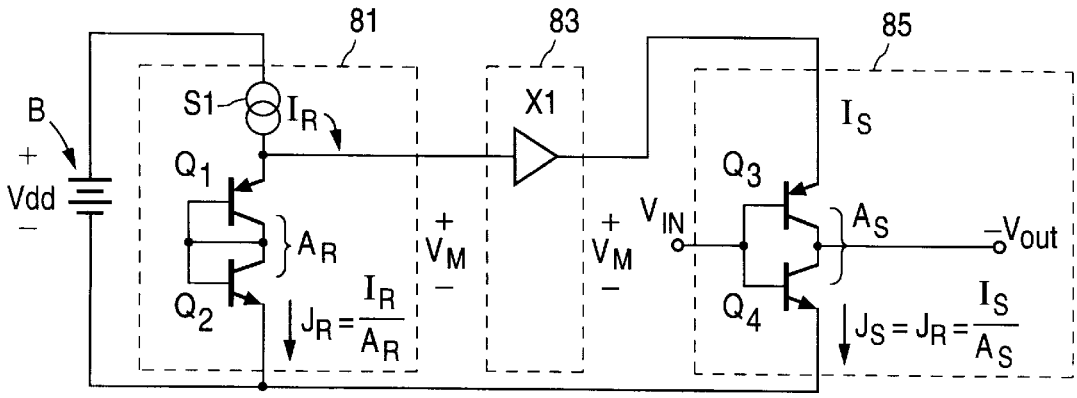
FIG. 10 is a schematic diagram of another preferred embodiment of the inventive system, which is implemented with bipolar transistors (rather than MOSFET devices as in FIG. 2).

The FIG. 10 circuit comprises master cell 81, current boosting voltage follower 83, and transconducting inverting slave cell 85. Optionally, additional slave cells are connected between the output of circuit 83 and ground in parallel with cell 85.

Battery B supplies voltage $V_{dd}$ across master cell 81. Cell 81 comprises current source S1 (which is a source of fixed current $I_R$) connected in series with pnp bipolar transistor Q1 and npn bipolar transistor Q2. Since it is well known how to design a source of fixed current $I_R$ that would be suitable for use in the FIG. 10 system, the details of such design are not discussed herein. The channels of transistors Q1 and Q2 are connected in series, and in essence these transistors comprise an inverter with its input (the common bases of Q1 and Q2) shorted with its output (the common collectors of Q1 and Q2). The emitter of Q1 is connected to one terminal of current source S1, and the emitter of Q2 is connected to ground. Battery B is connected between ground and the other terminal of current source S1 as shown, to cause constant current $I_R$ to flow from source S1 through the channels of Q1 and Q2.

Bias voltage $V_M$, asserted across current boosting voltage follower 83 by master cell 81, is the voltage at the emitter of transistor Q1, which is the sum of the base-to-emitter voltages of transistors Q1 and Q2. The constant channel current density $J_R$ of transistors Q1 and Q2 is determined by the current $I_R$ from current source S1 and the effective area $A_R$ of transistors Q1 and Q2, according to: $J_R=I_R/A_R$. The effective area $A_R$ is in turn determined by the effective channel width-to-length ratio of transistors Q1 and Q2. The constant current density $J_R$ is replicated in each of transistors Q3 and Q4 of slave cell 85 to cause subthreshold operation of the slave cell.

In slave cell 85, pnp bipolar transistor Q3 and npn bipolar transistor Q4 comprise an inverter. The input terminal for slave cell 85 (which receives input potential $V_{in}$) is the common bases of Q3 and Q4. The emitter of Q3 is connected to the output terminal of voltage follower 3 (and is thus held at bias potential $V_M$ above ground), the collector of Q3 is connected to the collector of Q4, and the emitter of Q4 is grounded. Voltage $V_M$ has a value which biases transistors Q3 and Q4 to operate in subthreshold. The common collectors of Q3 and Q4 comprise the output terminal of cell 85. The common bases of Q3 and Q4 receive input voltage $V_{in}$ and in response thereto the common collectors of Q3 and Q4 are at output voltage $-V_{out}$.

Voltage follower 83 is a unity gain buffer amplifier which functions to pass on voltage $V_M$ from master cell 81 to slave cell 85 while sourcing adequate current to cell 85 and each other slave cell connected to follower 83 in parallel with cell 85. Typically, the current drawn from follower 83 by the slave cell(s) is greater than master cell current $I_R$ The sum of the base-to-emitter voltages of both slave cell transistors (Q3 and Q4) is equal to the sum of the base-to-emitter voltages of both master cell transistors (Q1 and Q2). All of the slave transistors draw current from the $V_M$ line (the output of follower 83). The constraint that the base-to-emitter voltages of the slave cell transistors sum to a constant value (bias voltage $V_M$) is analogous to the constraint that the gate-to-source voltages in slave cell 5 of FIG. 2 sum to regulated bias voltage $V_M$ of the FIG. 2 system, and this constraint is preserved notwithstanding process and environment variations or variations in supply voltage $V_{dd}$ and/or input voltage $V_{in}$. Therein lies one of the essential aspects of the invention: process, environmental, and signal variations do not affect (to first order) the current density of the transistors of each embodiment of the inventive slave cell.

The FIG. 10 circuit (like other embodiments of the invention) is a current density replicator which is replicating current density (from master cell 81 to slave cell 85) in an amplifier configuration; not a current reflecting configuration as in a conventional current mirror. This allows the actual output voltage $-V_{out}$ (and output current) to be controlled dynamically in response to input voltage $V_{in}$, with a large value of slave cell transconductance.

FIG. 10 does not show circuitry (other than cell 81 and follower 83) for biasing transistor pair Q3, Q4 of slave cell 85. Feedback circuitry can be connected between cell 85's input and output (within cell 85 or external to cell 85), to cause cell 85 to implement a desired function (e.g., an integration function). For example, transistor pair Q3, Q4 can be biased by feedback from a feedback resistor coupled to the input terminal of slave cell 85 (such a resistor would self-bias the cell 85).

A fortuitous property of complementary bipolar inverter Q3, Q4 of cell 85 is that the base currents (for Q3 and Q4) are in opposing directions, and can at least partially nullify each other depending upon the symmetry of devices Q3 and Q4.

Figure 11:
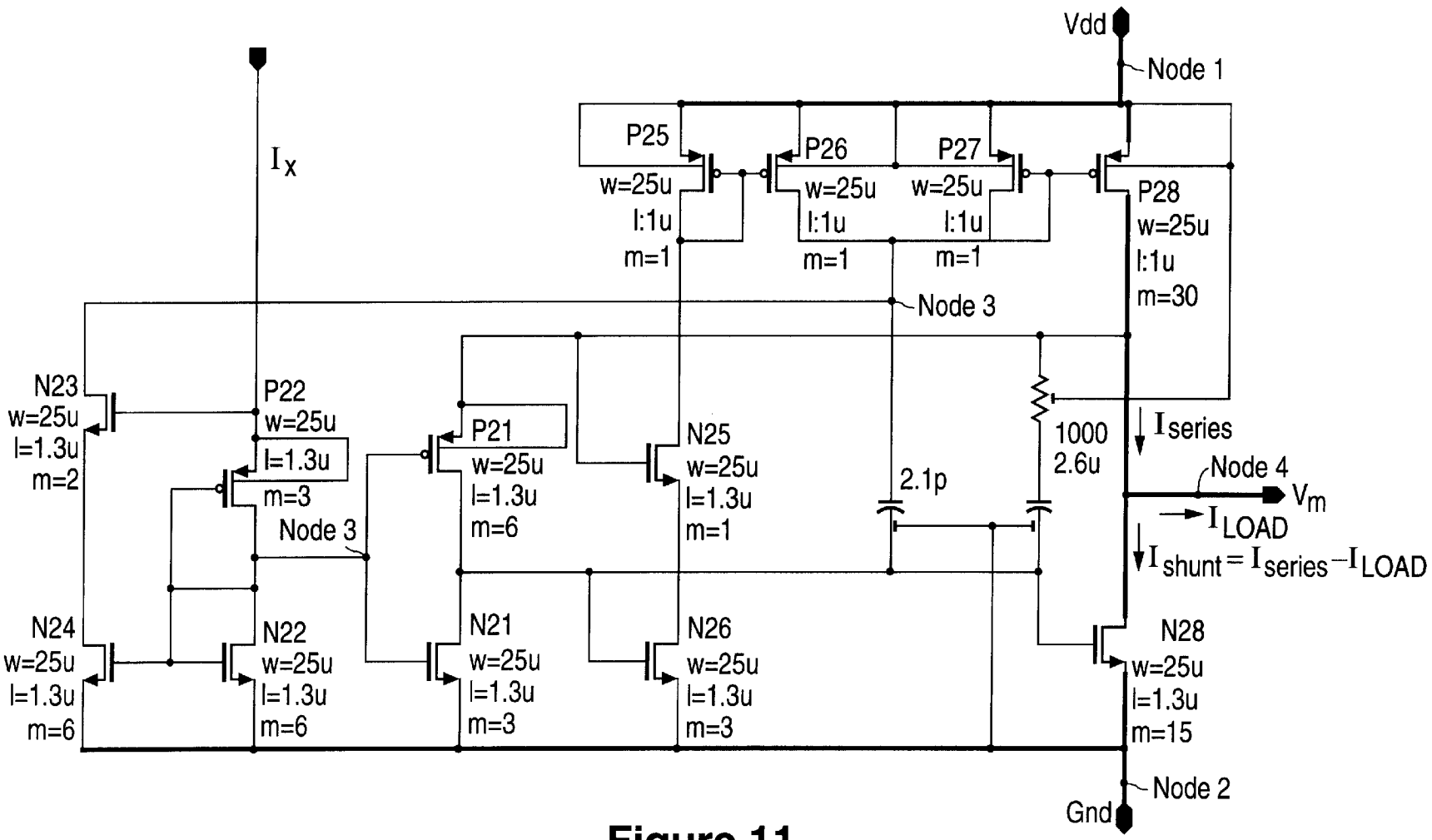
FIG. 11 is a schematic diagram of an alternative circuit which can replace master cell 1 and voltage follower 3 of FIG. 2, and which generates a regulated bias voltage for use in biasing one or more transconducting slave cells.

FIG. 11 is a schematic diagram of a preferred embodiment of a circuit which can replace master cell 1 and voltage follower 3 of FIG. 2. The FIG. 11 circuit generates regulated bias voltage $V_M$ which can be used to bias one or more transconducting slave cells (e.g., cell 5 of FIG. 2). In FIG. 11, PMOS transistor P28 and NMOS transistor N28 function as a combination of a shunt regulator (an active pull down device) and a series regulator (an active series pass device) to regulate the FIG. 11 circuit's output voltage $V_M$ (with P28 functioning as the series regulator and N28 functioning as the shunt regulator). A battery (not shown) typically provides supply voltage $V_{dd}$ between Node 1 (the source of P28) and Node 2 (the source of N28).

PMOS transistor P22 and NMOS transistor N22 of FIG. 11 correspond to transistors P1 and N1 of above-described FIG. 3, but are biased by current $I_x$ rather than by a fixed current from a fixed current source. Current $I_x$ preferably is supplied from circuitry (not shown) which is controllable to vary the value of $I_x$ when desired, which in turn varies the voltage at Node 3 and thus the value of the bias voltage $V_M$. The common drains of transistors P22 and N22 are coupled to the common gates of PMOS transistor P21 and NMOS transistor N21.

PMOS transistor P21 and NMOS transistor N21 correspond to transistors P11 and N11 of above-described FIG. 3. Transistors P11 and N11 comprise a CMOS inverter whose output (the common drains of P11 and N11) is coupled to the gate of NMOS transistor N28. The channel current through P21 and N21 is a portion of the "series" current $I_{series}$ through transistor P28. Transistors P21 and N21 are sized (with effective area $A_S$) so that the current density in their channel ($J_S=I_S/A_S$, where $I_S$ is the channel current through P21) is equal to the current density of P22 and N22, so that the output node of FIG. 11 (the common source of P21 and drain of N28) remains stably at the bias voltage $V_M$ above ground, even with variable load current $I_{load}$ being drawn from the output node (by the transconducting slave cell or cells connected between the output node and ground).

If load current $I_{load}$ changes (thus tending to change the gate-to-source voltage of transistor P21 and thus the voltage $V_M$), there will be a compensating change in the drain-to-source voltage of transistor N28 and in the drain-to-source voltage of transistor P22 which tends to restore voltage $V_M$ to its equilibrium value (the value which balances transistors P21 and N21). For example, if $I_{load}$ increases (when output voltage $V_M$ is at its equilibrium value):

- this increase initially decreases the output voltage (at Node 4) and thus decreases the potential at the source of P21 (possibly by a large amount), which in turn increases the potential at the gate of transistor N28 (the channel current through N21 remains fixed despite variations in the load current $I_{load}$, since this current is determined by the channel current through N22 which remains fixed while current $I_x$ remains fixed). The increase in the gate potential of "shunt" transistor N28 in turn increases the current $I_{shunt}$ flowing through transistor N28, which raises the potential $V_M$ at output Node 4 (thus compensating for the initial drop in the potential $V_M$ at output Node 4); and
- the increase in $I_{load}$ initially decreases the potential at the gate of NMOS transistor N25 (the gate of N25 is connected to output Node 4, the drain of N25 is connected to the common drain and gate of PMOS transistor P25, and the source of N25 is connected to the drain of NMOS transistor N26), which in turn decreases the current flowing through transistors N25 and N26 and thus decreases the current flowing through transistor P25. Transistor N26 drives a servo loop which produces a controlled variation in the currents through N28 and P28. The sources of PMOS transistors P25, P26, P27, and P28 are connected to Node 1 (and thus are held at supply potential $V_{dd}$), and the drains of P26 and P27, the gates of P27 and P28, and the drain of NMOS transistor N23 are all connected at Node 3. The source of N23 is connected to the drain of NMOS transistor N24, the source of N24 is grounded, the gate of N23 is connected to the source of P22, and the gate of N24 is connected to the common gates of P22 and N22, as shown. PMOS transistor P26 is a current mirror, and thus when the current through P25 decreases, the current through P26 also decreases. As a result, the current through P27 increases (since the residual current flowing from Node 3 through N23 and N24 to ground remains fixed), and thus the potential at the gate of "series" transistor P28 decreases, which in turn increases the flow of current through P28 which further raises the potential $V_M$ at output Node 4 (thus further compensating for the initial drop in the potential $V_M$ at output Node 4).

Of course, if $I_{load}$ decreases (when output voltage $V_M$ is at its equilibrium value), this increase initially increases output voltage $V_M$ (at output Node 4). This in turn decreases the amount of shunt current $I_{shunt}$ through transistor N28 and decreases the flow of "series" current $I_{series}$ through transistor P28, both of which effects lower the potential $V_M$ at output Node 4 (thus compensating for the initial drop in $V_M$).

An advantage of the FIG. 11 circuit is the high degree of control it provides over the currents through transistors P28 and N28. With inadequate control, the current through both devices could be too high (so that the circuit consumes too much power), or it could be too low (raising the effective output impedance of the circuit). The control is provided by controlling $I_{series}$ and $I_{shunt}$ (which are related by $I_{shunt}=I_{series}-I_{load}$), which is determined by the dual path regulator circuitry comprising transistors N26, N25, P25, P26, P27, and P28 in conjunction with transistor N28. The currents $I_{series}$ and $I_{shunt}$ are also related as follows: $I_{series}=n\ (I_{ref})[(1-a)+(1+a)/n]$, $I_{load}=n(I_{ref})[1-a(1+k/n)]$, and $I^{shunt}=ka\ (I_{ref})$, where "a" is an independent variable that models how the load current varies, $I_{ref}$ is a reference current for the output of the regulator, and "k" and "n" are design variables that influence the relative proportion of the PMOS and NMOS output stage currents. These relationships are quite linear with variations in load current. In practice, "k" and "n" are independent design variables, typically k=2, n=5, and $I_{ref}$=25 microAmps. The variable "a" is in the range from 0 to 1 (at a value which is a parametric function of the load current $I_{load}$. Under these conditions, $I_{load}$ varies from 0 to 1 mA, $I_{shunt}$ varies from 200 microAmps to 0, and $I_{series}$ varies from 200 microAmps to about 1 mA.

Changes in k and n can increase the total efficiency of the current into the load versus the supply current, but at the expense of raising the output impedance, or vice versa. The operating currents in transistors P28 and N28 determine the output impedance of the regulator in conjunction with the gain of the error amplifier P21 and N21.

By employing a linear, predictable relationship between both the series and shunt current paths, the minimum open loop and closed loop output impedances of the FIG. 11 circuit are typically maintained over wide variations of $I_{load}$.

The additional complexity of the FIG. 11 circuit relative to that of FIG. 3 results (in many applications) in better regulation of bias voltage $V_M$ over a wider range of load currents, without prior knowledge of maximum load current as is needed to design the FIG. 3 circuit. In many applications, the additional complexity of the FIG. 11 circuit (and that of FIG. 3) relative to that of FIG. 2 results in good regulation of bias voltage $V_M$ over a wide range of load currents (including rapidly varying transient load currents), without the need for a complicated current boosting voltage follower (which is typically implemented using a complicated op amp circuitry) as is needed in some applications of the FIG. 2 circuit.

Although only certain embodiments have been described in detail, those having ordinary skill in the art will certainly understand that many modifications are possible without departing from the teachings thereof. All such modifications are intended to be encompassed within the following claims.

What is claimed is:

1. A transconducting circuit, including:

a master cell configured to assert a regulated bias voltage in response to an unregulated supply voltage, wherein the bias voltage has a lower magnitude relative to ground than does the supply voltage; and a transconducting slave cell coupled to receive the bias voltage and configured to operate in subthreshold in response to said bias voltage, wherein the transconducting slave cell includes a CMOS inverter comprising a PMOS transistor having a gate and a drain, and an NMOS transistor having a gate coupled to the gate of the PMOS transistor at a first node coupled to receive an input voltage, the NMOS transistor having a drain coupled to the drain of the PMOS transistor at a second node, and the PMOS transistor having a source coupled to receive the bias voltage.

2. The circuit of claim 1, wherein the transconducting slave cell also includes a feedback circuit connected between the first node and the second node.

3. The circuit of claim 2, wherein the feedback circuit includes a capacitor connected between the first node and the second node.

4. A transconducting circuit, including:

a master cell configured to assert a regulated bias voltage in response to an unregulated supply voltage, wherein the bias voltage has a lower magnitude relative to ground than does the supply voltage; and a transconducting slave cell coupled to receive the bias voltage and configured to operate in subthreshold in response to said bias voltage, wherein the master cell includes:

at least one transistor; and circuitry configured to maintain a constant current density in said at least one transistor, thereby causing said at least one transistor to assert said bias voltage in such a manner that said bias voltage remains at least substantially fixed despite process and environmental variations including variations in the unregulated supply voltage, and wherein the transconducting slave cell includes at least one slave cell transistor which operates in subthreshold in response to said bias voltage, and wherein the transconducting slave cell is configured to replicate the constant current density in said at least one slave cell transistor when said transconducting slave cell receives the bias voltage.

5. The circuit of claim 4, wherein each said slave cell transistor is fabricated to have a channel width-to-length ratio that is sufficiently large so that there is a very low constant current density in each said slave cell transistor during subthreshold operation thereof.

6. A transconducting circuit, including:

a master cell configured to assert a regulated bias voltage in response to an unregulated supply voltage, wherein the bias voltage has a lower magnitude relative to ground than does the supply voltage; and a transconducting slave cell coupled to receive the bias voltage and configured to operate in subthreshold in response to said bias voltage, wherein the master cell includes a current source, a PMOS transistor having a gate at a first node and a drain coupled to the first node, and an NMOS transistor having an NMOS transistor gate coupled to the first node and an NMOS transistor drain coupled to the first node, wherein the PMOS transistor has a source coupled to the current source at a second node, and the bias voltage is the potential at the second node.

7. The circuit of claim 6, wherein the transconducting slave cell includes a CMOS inverter comprising a second PMOS transistor having a gate and a drain, and a second NMOS transistor having a gate coupled to the gate of the second PMOS transistor at a third node coupled to receive an input voltage, wherein the second NMOS transistor has a drain coupled to the drain of the second PMOS transistor at a fourth node, the second PMOS transistor has a source coupled to receive the bias voltage, the NMOS transistor has a grounded source, and the second NMOS transistor has a source connected to the grounded source of the NMOS transistor.

8. A transconducting circuit, including:

a master cell configured to assert a regulated bias voltage in response to an unregulated supply voltage, wherein the bias voltage has a lower magnitude relative to ground than does the supply voltage;

at least one transconducting slave cell coupled to receive a second voltage at least substantially equal to the bias voltage and configured to operate in subthreshold in response to said second voltage; and a current boosting voltage follower coupled between the master cell and each said transconducting slave cell, and configured to receive the bias voltage and to assert the second voltage to each said transconducting slave cell in response to the bias voltage.

9. The circuit of claim 8, wherein said at least one transconducting slave cell include a first transconducting slave cell and a second transconducting slave cell, the first transconducting slave cell is coupled to the current boosting voltage follower so as to receive the second voltage, and the second transconducting slave cell is coupled to the current boosting voltage follower in parallel with the first transconducting slave cell slave cell so as to receive the second voltage.

10. The circuit of claim 8, wherein the master cell includes:

at least one transistor; and circuitry configured to maintain a constant current density in said at least one transistor, thereby causing said at least one transistor to assert said bias voltage in such a manner that said bias voltage remains at least substantially fixed despite process and environmental variations including variations in the unregulated supply voltage, and wherein the transconducting slave cell includes at least one slave cell transistor and is configured to replicate the constant current density in said at least one slave cell transistor when said transconducting slave cell receives the bias voltage.

11. The circuit of claim 10, wherein each said slave cell transistor is fabricated to have a channel width-to-length ratio that is sufficiently large so that there is a very low constant current density in each said slave cell transistor during subthreshold operation thereof.

12. The circuit of claim 8, wherein the transconducting slave cell includes a CMOS inverter comprising a PMOS transistor having a gate and a drain, and an NMOS transistor having a gate coupled to the gate of the PMOS transistor at a first node coupled to receive an input voltage, the NMOS transistor having a drain coupled to the drain of the PMOS transistor at a second node, and the PMOS transistor having a source coupled to receive the second voltage.

13. The circuit of claim 12, wherein the transconducting slave cell also includes a feedback circuit connected between the first node and the second node.

14. A transconducting circuit, including:

at least one transconducting slave cell coupled to receive a regulated bias voltage and configured to operate in subthreshold in response to said regulated bias voltage; and a master cell coupled to the at least one transconducting slave cell so as to assert the regulated bias voltage to said at least one transconducting slave cell, wherein the master cell is configured to generate the regulated bias voltage in response to an unregulated supply voltage such that the regulated bias voltage has a lower magnitude relative to ground than does the supply voltage, and wherein the master cell includes regulator circuitry configured to provide precise regulation of the regulated bias voltage over a wide range of load current drawn from the master cell by said at least one transconducting slave cell.

15. The circuit of claim 14, wherein the master cell includes:

a PMOS transistor having a gate at a first node, a drain coupled to the first node, and a source coupled to draw a reference current;

an NMOS transistor having a gate coupled to the first node, a drain coupled to the first node, and a grounded source;

a second PMOS transistor having a gate coupled to the first node, a source coupled to the regulator circuitry at an output node, and a drain coupled to the regulator circuitry at a second node, wherein the master cell asserts the regulated bias voltage at the output node; and a second NMOS transistor having a gate coupled to the first node, a drain coupled to the second node, and a grounded source.

16. A transconducting circuit, including:

a master cell configured to assert a regulated bias voltage in response to an unregulated supply voltage, wherein the bias voltage has a lower magnitude relative to ground than does the supply voltage; and a transconducting slave cell coupled to receive the bias voltage and configured to operate in subthreshold in response to said bias voltage, wherein the slave cell includes multiple stages connected in series, each of the stages comprising a transconducting circuit including at least one transistor coupled to receive the bias voltage and biased in subthreshold by said bias voltage.

17. The circuit of claim 16, wherein each of the transistors includes a PMOS transistor having a source coupled to receive the bias voltage and a channel, and an NMOS transistor having a channel connected in series with the channel of the PMOS transistor.

18. The circuit of claim 16, wherein the transconducting slave cell is an integrator, each of a first subset of the stages is an inverter stage, and at least one of the stages is a feedback stage configured to provide displacement current to at least one said inverter stage.

19. The circuit of claim 18, wherein the transconducting slave cell is an integrator, each of a first subset of the stages is an inverter stage, and at least one of the stages is a feedback stage configured to provide displacement current to at least one said inverter stage.

20. The circuit of claim 18, wherein the integrator comprises:

a first inverter stage having an input coupled to receive an input voltage and a first output;

a second inverter stage having a second input coupled to the first output, and having a second output;

a feedback inverter stage having a feedback stage output coupled to provide displacement current to the second input and having a feedback stage input;

a third inverter stage having a third input coupled to the feedback stage input and a third output coupled to assert an integrator output voltage;

a first capacitor coupled between the first output and the second output;

circuitry including a second capacitor coupled between the second output and the third input; and additional circuitry including a third capacitor coupled between the third input and the third output.

21. The circuit of claim 16, wherein transconducting slave cell comprises:

a PMOS transistor having a source coupled to receive the bias voltage at a first node, a gate at a second node coupled to receive an input voltage, and a drain at a third node;

an NMOS transistor having a gate coupled to the first node, a drain coupled to the third node, and a grounded source;

a second PMOS transistor having a source coupled to receive the bias voltage, a gate coupled to the third node, and a drain at an output node;

a capacitor connected between the third node and the output node; and a second NMOS transistor having a gate coupled to the third node, a drain coupled to the output node, and a grounded source.

22. The circuit of claim 16, wherein transconducting slave cell comprises:

a PMOS transistor having a source coupled to receive the bias voltage at a first node, a gate at a second node coupled to receive an input voltage, and a drain at a third node;

an NMOS transistor having a gate coupled to the first node, a drain coupled to a fourth node, and a grounded source;

a current mirror circuit having a first input coupled to the third node, a second input coupled to the fourth node, and an output at a fifth node;

a second PMOS transistor having a source coupled to receive the bias voltage, a gate coupled to the fifth node, and a drain at an output node;

a capacitor connected between the fifth node and the output node; and a second NMOS transistor having a gate coupled to the fifth node, a drain coupled to the output node, and a grounded source.

23. The circuit of claim 22, wherein the current mirror circuit comprises:

a third NMOS transistor having a gate and a drain coupled to the third node, and a grounded source;

a fourth NMOS transistor having a gate coupled to the third node, a drain coupled to the fifth node, and a grounded source;

a third PMOS transistor having a gate and a drain coupled to the fourth node, and a source coupled to receive the bias voltage; and a fourth PMOS transistor having a source coupled to receive the bias voltage, a gate coupled to the fourth node, and a drain coupled to the fifth node.

24. The circuit of claim 16, wherein the master cell includes:

at least one transistor; and circuitry configured to maintain a constant current density in said at least one transistor, thereby causing said at least one transistor to assert said bias voltage in such a manner that said bias voltage remains at least substantially fixed despite process and environmental variations including variations in the unregulated supply voltage, and wherein the transconducting slave cell is configured to replicate the constant current density in said at least one transistor in each of the stages when each of said stages receives the bias voltage.

25. A method for programming a subthreshold current density in a transconducting slave cell, including the steps of:

regulating an unregulated supply voltage to maintain a constant current density in at least one transistor, thereby generating a regulated bias voltage such that said bias voltage has a lower magnitude relative to ground than does the supply voltage and such that said bias voltage remains substantially fixed despite supply voltage variations; and replicating the constant current density in the transconducting slave cell, including by biasing said transconducting slave cell using the bias voltage, thereby causing said transconducting slave cell to operate in subthreshold despite process and environmental variations including variations in the supply voltage.

26. A method for biasing a transconducting slave cell to operate in subthreshold, wherein the slave cell includes at least one transistor, said method including the steps of:

(a) generating a regulated bias voltage in response to an unregulated supply voltage, wherein the bias voltage has a lower magnitude relative to ground than does the supply voltage; and (b) asserting the bias voltage to a channel terminal of said at least one transistor in the transconducting slave cell, thereby biasing said transconducting slave cell to operate in subthreshold, wherein step (a) includes the step of maintaining a constant current density in at least one master cell transistor, thereby causing said at least one master cell transistor to assert said bias voltage to the transconducting slave cell in such a manner that said bias voltage remains at least substantially fixed despite process and environmental variations including variations in the unregulated supply voltage, and wherein step (b) includes the step of replicating the constant current density in said at least one transistor of the transconducting slave cell when said transconducting slave cell receives the bias voltage.

27. The circuit of claim 5, wherein each said slave cell transistor is fabricated to have a channel current substantially equal to 10 microAmps during subthreshold operation thereof.

28. The circuit of claim 11, wherein each said slave cell transistor is fabricated to have a channel current substantially equal to 10 microAmps during subthreshold operation thereof.

* * * * *